US009852605B2

(12) United States Patent
Dey et al.

(10) Patent No.: US 9,852,605 B2
(45) **Date of Patent: *Dec. 26, 2017**

(54) SYSTEMS AND METHODS OF DYNAMICALLY VARYING A PRE-ALARM TIME OF A SECURITY SYSTEM

(71) Applicant: Google Inc., Mountain View, CA (US)

(72) Inventors: Sourav Raj Dey, South San Francisco, CA (US); Mark Rajan Malhotra, San Mateo, CA (US); Yash Modi, San Mateo, CA (US)

(73) Assignee: GOOGLE LLC, Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/370,287

(22) Filed: Dec. 6, 2016

(65) Prior Publication Data

US 2017/0084161 A1 Mar. 23, 2017

Related U.S. Application Data

(63) Continuation of application No. 14/800,863, filed on Jul. 16, 2015, now Pat. No. 9,552,719.

(51) Int. Cl.

| | |
|---|---|
| ***G08B 23/00*** | (2006.01) |
| ***G08B 25/00*** | (2006.01) |
| ***G08B 25/14*** | (2006.01) |
| ***G08B 29/20*** | (2006.01) |

(52) U.S. Cl.

CPC ..... *G08B 25/002* (2013.01); *G08B 25/008* (2013.01); *G08B 25/14* (2013.01); *G08B 29/20* (2013.01)

(58) Field of Classification Search

CPC .. G08B 25/008; G08B 25/001; G08B 25/002; G08B 21/0233; G08B 21/0225; G08B 31/00; G08B 13/00

USPC ..... 340/528, 517, 511, 541, 565, 545.6, 340/545.7, 545.8, 545.9

See application file for complete search history.

(56) References Cited

U.S. PATENT DOCUMENTS

| | | | | |
|---|---|---|---|---|
| 5,003,290 | A | 3/1991 | Lindquist et al. | |
| 5,216,407 | A | 6/1993 | Hwang | |
| 5,534,849 | A | 7/1996 | McDonald et al. | |
| 7,409,045 | B2 | 8/2008 | Glasgow et al. | |
| 8,583,167 | B2 | 11/2013 | Chun et al. | |
| 8,599,018 | B2 | 12/2013 | Kellen et al. | |
| 8,953,749 | B2 | 2/2015 | Glasgow et al. | |
| 9,552,719 | B1 * | 1/2017 | Dey | G08B 25/008 |
| 2006/0176167 | A1 | 8/2006 | Dohrmann | |
| 2007/0247302 | A1 | 10/2007 | Martin | |

(Continued)

OTHER PUBLICATIONS

Extended European Search Report dated Dec. 13, 2016 as received in Application No. 16179749.3.

*Primary Examiner* — Toan N Pham

(74) *Attorney, Agent, or Firm* — Morris & Kamlay LLP

(57) ABSTRACT

Systems and methods of adjusting a pre-alarm time are provided, including detecting, by a sensor, an entry into a building by a person and generating detection data according to the detected entry. A processor communicatively coupled to the sensor adjusts a pre-alarm time according to the detection data. An alarm is output, by an alarm device communicatively coupled to at least the processor, according to the detection data and the adjusted pre-alarm time.

40 Claims, 10 Drawing Sheets

(56) References Cited

U.S. PATENT DOCUMENTS

| | | | |
|---|---|---|---|
| 2009/0152347 | A1 | 6/2009 | Peyrot |
| 2010/0045461 | A1 | 2/2010 | Caler et al. |
| 2012/0286951 | A1 | 11/2012 | Hess et al. |

* cited by examiner

SYSTEMS AND METHODS OF DYNAMICALLY VARYING A PRE-ALARM TIME OF A SECURITY SYSTEM

BACKGROUND

Traditional home security systems must be disarmed by a user after entering a home to avoid having an alarm be activated. Typically, a user has a preset time (i.e., pre-alarm time), such as 30 seconds to disarm the home security system once the user has returned and entered the home. Generally, false alarms occur when the user is entering their own home. That is, when a user enters their home when the home security system is activated, the system detects the user and enters into a pre-alarm (i.e., heads-up) mode. At that point, the user has the preset time (e.g., 30 seconds) to disarm the alarm. If the user does not disarm the alarm (e.g., by entry of a security code or the like), an audio and/or visual alarm is output, and law enforcement or a security company will be contacted.

BRIEF SUMMARY

Implementations of the disclosed subject matter provide a security system of a smart home environment to vary the pre-alarm time to reduce the number of false alarms that are triggered by a user. The pre-alarm may be varied according to the user (e.g., different users may have different pre-alarm time). The security system of the smart home environment may vary the pre-alarm time according to the entrance used. That is, there may be different pre-alarm times assigned to different doors of the home that are used for entry. The security system may detect changes in the amount of time a user needs to disarm the security system, and may adjust the amount of pre-alarm time gradually, so as to provide the user sufficient time so as not to feel rushed and to minimize the number of false alarms. For example, the security system may learn that a user needs less time than the set pre-alarm time to disarm the security system, and the system may gradually reduce the amount of pre-alarm time over a period of weeks. In some implementations, the pre-alarm time may be increased when a user is authorized and/or identified by the security system.

Implementations of the disclosed subject matter also reduce the pre-alarm time to disarm the security system when there is an actual intrusion to the home (i.e., by an unauthorized person). That is, with a reduced pre-alarm time, an alarm of the home security system may be activated when intruders will be in the home. Thus, it may be more likely that law enforcement will intervene quickly to be able to apprehend the intruders. Pre-alarm time may be reduced by the security system according to the detected point of entry (e.g., if the point of entry is a window and/or is a door that is infrequently used by an authorized user). Pre-alarm time may be reduced according to whether the time of entry is typical (e.g. from a learned pattern of use) for the user. That is, when the entry is not at a typical time, the pre-alarm time may be reduced.

According to an implementation of the disclosed subject matter, a security system is provided that includes a sensor to detect an entry into a building by a person, and generate detection data according to the detected entry, a processor communicatively coupled to the sensor to receive the detection data, and to adjust a pre-alarm time according to the detection data, and an alarm device, communicatively coupled to at least the processor, that outputs an alarm according to the detection data and the adjusted pre-alarm time.

According to an implementation of a disclosed subject matter, a method is provided that includes detecting, by a sensor, an entry into a building by a person and generating detection data according to the detected entry, adjusting, by a processor communicatively coupled to the sensor, a pre-alarm time according to the detection data, and outputting an alarm, by an alarm device communicatively coupled to at least the processor, according to the detection data and the adjusted pre-alarm time.

According to an embodiment of the disclosed subject matter, means for adjusting a pre-alarm time are provided, including detecting, by a sensor, an entry into a building by a person and generating detection data according to the detected entry, adjusting, by a processor communicatively coupled to the sensor, a pre-alarm time according to the detection data, and outputting an alarm, by an alarm device communicatively coupled to at least the processor, according to the detection data and the adjusted pre-alarm time.

Additional features, advantages, and implementations of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate implementations of the disclosed subject matter and together with the detailed description serve to explain the principles of implementations of the disclosed subject matter. No attempt is made to show structural details in more detail than may be necessary for a fundamental understanding of the disclosed subject matter and various ways in which it may be practiced.

DETAILED DESCRIPTION

Figure 1:
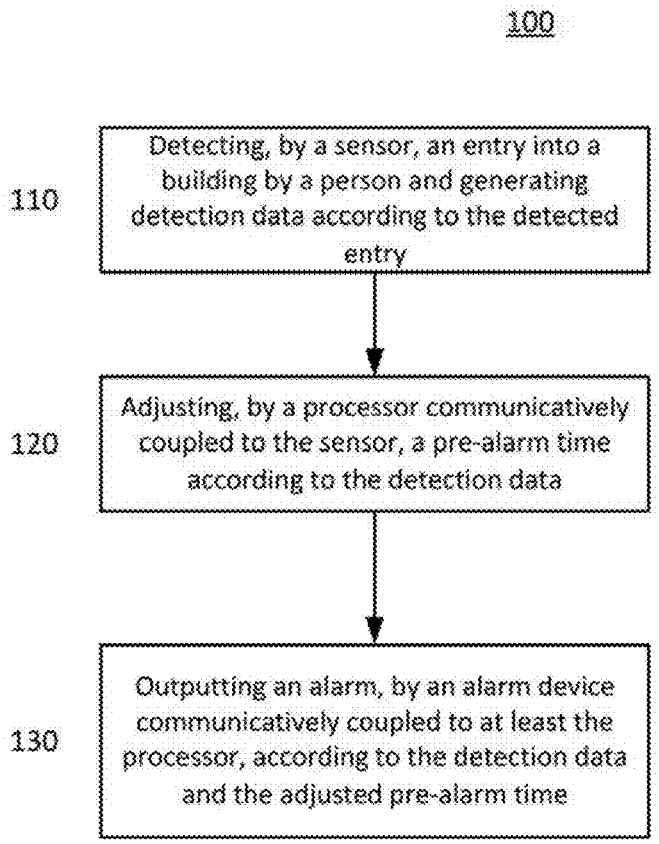
FIG. 1 shows an example method of adjusting a pre-alarm time according to an implementation of the disclosed subject matter.

Implementations of the disclosed subject matter provide systems and methods of varying the pre-alarm time of a security system of a smart home environment to provide sufficient time for a user to enter a home so that they do not feel rushed when attempting to disarm the security system. The security system may vary the pre-alarm time according to the time of entry (e.g., time of day that the entry is occurring), the point of entry (e.g., different doors may allow for different pre-alarm times), and the user who is entering (e.g., different users may be allotted different pre-alarm times). The security system may learn the time needed by the user for the pre-alarm time, and may adjust the pre-alarm time over a particular period (e.g., one week, several weeks, or the like). The security system may also learn the point of entry (e.g., doors) that a user typically uses for entry, and/or the time of entry, and may adjust the pre-alarm time. That is, in implementations of the disclosed subject matter, the security system varies the pre-alarm time so as to not rush the user in disarming the security system, and reduce the number of false alarms.

By reducing the pre-alarm time when an intrusion is detected, the security system of the smart home environment may provide law enforcement and/or security personnel with additional response time when an intrusion is detected. That is, with a reduced pre-alarm time, an alarm of the home security system may be activated when intruders will be in the home. Accordingly, it is more likely that law enforcement and/or security personnel may intervene to be able to apprehend the intruders.

Implementations of the disclosed subject matter provide a smart home environment with a security system, having sensors to monitor doors, windows, and/or rooms of a home. The implementations of the disclosed subject matter provide systems and methods of determining when to output an alarm, and adjusting a pre-alarm time of the security system when the security system is armed and/or is in a particular operation mode (e.g., a stay mode, an away mode, a vacation mode, or the like). The smart home environment may secure a home against intrusions by determining intrusion events with one or more sensors, and outputting an alarm. The implementations of the disclosed subject matter may minimize the number of false alarms. For example, the smart home environment may "learn" the typical points and/or times of entry into a home for a user, which may minimize the number of false alarms.

In implementations of the disclosed subject matter, sensors of the smart home environment (e.g., sensors 71, 72 shown in FIGS. 7A-7B) may minimize power consumption. For example, events detected by the sensors may be transmitted to a controller (e.g., controller 73 shown in FIGS. 7A-7B) to determine whether the detected event is an intrusion event. That is, the controller may not poll the sensor (e.g., periodically request data to be transmitted from the sensor to the controller), and the sensors may detect security events and transmit them to the controller.

In some implementations, bandwidth of a network (e.g., network 70 shown in FIGS. 7A-7B) of the smart home environment may be an issue. That is, the amount of data transmitted from the sensors (e.g., sensors 71, 72 shown in FIGS. 7A-7B) to the controller (e.g., controller 73 shown in FIGS. 7A-7B) may be minimized, and determinations regarding intrusions may be made, at least in part, at the sensor (e.g., by processor 64 shown in FIG. 6).

In some implementations, flexibility of the intrusion detection system of the smart home environment may be increased by transmitting data from the sensors (e.g., "raw" data as captured by the sensor) to the controller, such that intrusion detection decisions may be made by the controller. That is, as bandwidth, power, and/or the number and/or type of sensor changes, the system may determine an intrusion event. In this implementation, it may be easier for a user to update the controller than to individually update the sensors.

In implementations of the disclosed subject matter, the security system of the smart home environment may reduce the latency in detecting an intrusion event. That is, implementations may be configured to output an alarm when atypical events and/or intrusion events are detected.

Figure 6:
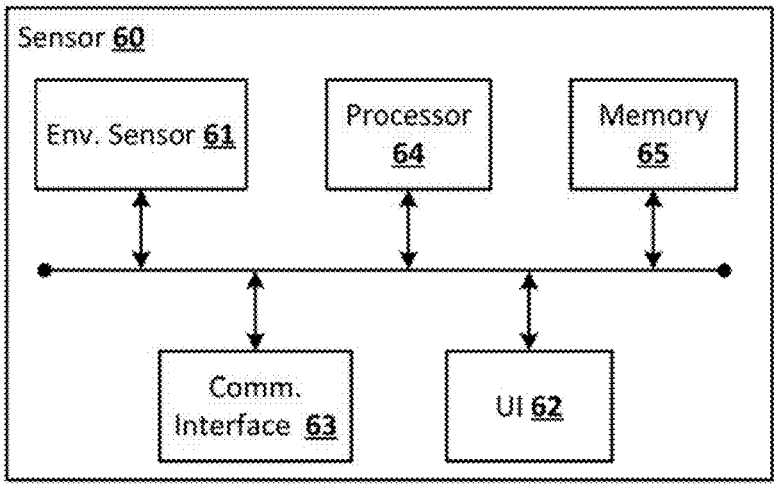
FIG. 6 shows an example sensor according to an implementation of the disclosed subject matter.

Although the sensors (e.g., sensors 71, 72 shown in FIGS. 7A-7B and/or sensor 60 shown in FIG. 6) may include memory (e.g., memory 65 as shown in FIG. 6), some implementations of the disclosed subject matter may minimize the memory requirements of the sensors, and thus sensor samples may be stored by the controller and/or with a storage device (e.g., remote system 74 shown in FIGS. 7A-7B) communicatively coupled to the controller.

FIG. 1 shows an example method 100 of adjusting a pre-alarm time according to an implementation of the disclosed subject matter. At operation 110, a sensor (e.g., sensor 71, 72 shown in FIGS. 7A-7B and/or sensor 60 shown in FIG. 6) of the smart home environment discussed in detail below may detect an entry into a home by a person and generate detection data according to the detected entry. As discussed in detail below, the sensor may detect motion and/or movement in position of a door and/or window to determine entry into a home.

A processor (e.g., processor 64 show in FIG. 6 and/or controller 73 shown in FIGS. 7A-7B) that is coupled to the sensor may adjust a pre-alarm time according to the detection data at operation 120. The processor may be a controller of the security system of the smart home environment. That is, as discussed in detail below in connection with FIGS. 2A-5, the processor may decrease the pre-alarm time when there is an entry at an atypical entry point (e.g., a window, a door that is not commonly used, or the like). The processor may increase the pre-alarm time when the person is authenticated (e.g., using data transmitted from a user device to the processor) so that the user does not need to rush to disarm the security system. If the security system identifies and/or authenticates a user, the processor may adjust the amount of pre-alarm time according to the identity of the user. That is, some users may be provided with more time or less time pre-alarm time. By adjusting the pre-alarm time, the security system may reduce false alarms and allow the user not to feel rushed when disarming.

An alarm device (e.g., alarm device 76 show in FIG. 7B) communicatively coupled to at least the processor (e.g., processor 64 show in FIG. 6 and/or controller 73 shown in FIGS. 7A-7B) may output an alarm according to the detection data and the adjusted pre-alarm time at operation 130. That is, if the processor determines that it is likely an intruder has entered, the pre-alarm time is reduced, and the alarm is output when the reduced pre-alarm time has elapsed. In some example, the pre-alarm time may approach zero. Law enforcement and/or security personnel may be contacted to respond to the alarm. When the pre-alarm time is increased so that a user is provided sufficient time to disarm the security system when returning home, the number of false alarms (i.e., alarms output by the alarm device for a non-intrusion event by the user) may be reduced.

The method 100 may include determining, according to the detection data, whether the person is an authorized user. For example, the security system (e.g., the controller 73 shown in FIGS. 7A-7B) may determine that the user is an authorized user from data (e.g., authentication data) transmitted from a user device (e.g., a smart phone, a smart watch, a key FOB, wearable computing device, or the like, such as device 75 of FIG. 7B). The received data may be compared with data of authorized users stored by the controller (e.g., controller 73 and/or a storage device coupled to controller 73). The processor may adjust the pre-alarm time so as to reduce the pre-alarm time (e.g., so as to approach zero) when the person is not an authorized user. That is, by reducing the pre-alarm time, an alarm may be output by the security system for a detected intruder, and law enforcement and/or security personnel may be alerted so that the intruder may be apprehended. The processor may increase the pre-alarm time when the person is determined to be an authorized user. That is, an authorized person may be given more time to disarm the security system (e.g., enter a password and/or passcode or the like) so as to reduce the number of false alarms. The security system may distinguish between authorized users according to the transmitted data, and may provide one user with a longer or shorter period of pre-alarm time than a second user.

In some implementations of the disclosed subject matter, the method may include determining a location of the entry of the person according to the detection data. That is, one or more sensors (e.g., sensors 71, 72 shown in FIGS. 7A-7B) may detect an entry of a person, and may transmit the detection data to the controller of the security system, which may determine the location of the person according to the data transmitted by the sensor (e.g., the identity of the sensor and/or detection data being provided by the sensor to the controller). The controller of the security system adjusting, by the processor, the pre-alarm time according to the determined location of the entry of the person.

Figure 2A:
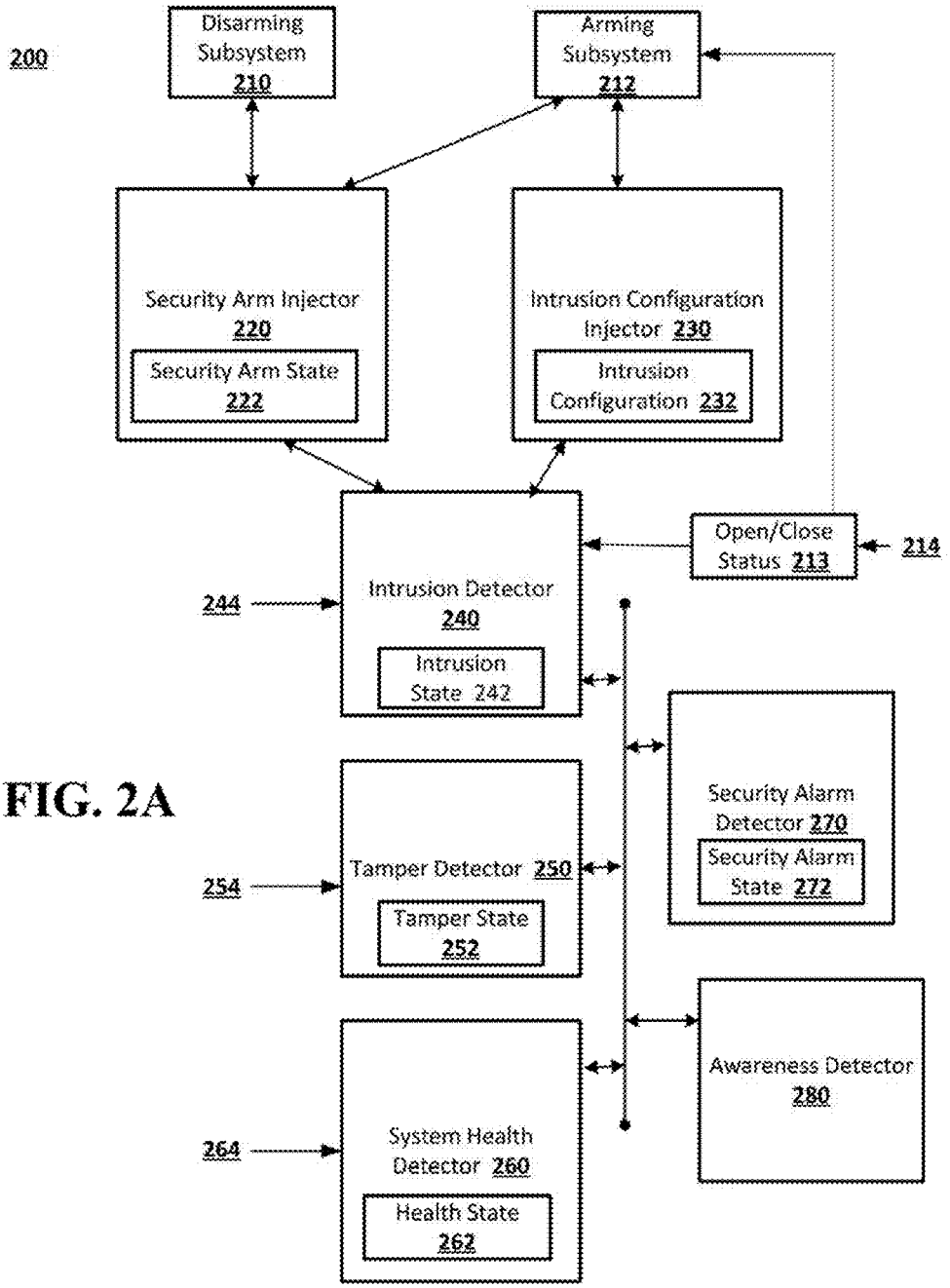
FIGS. 2A-2B show devices of a security system according to an implementation of the disclosed subject matter.
Figure 2B:
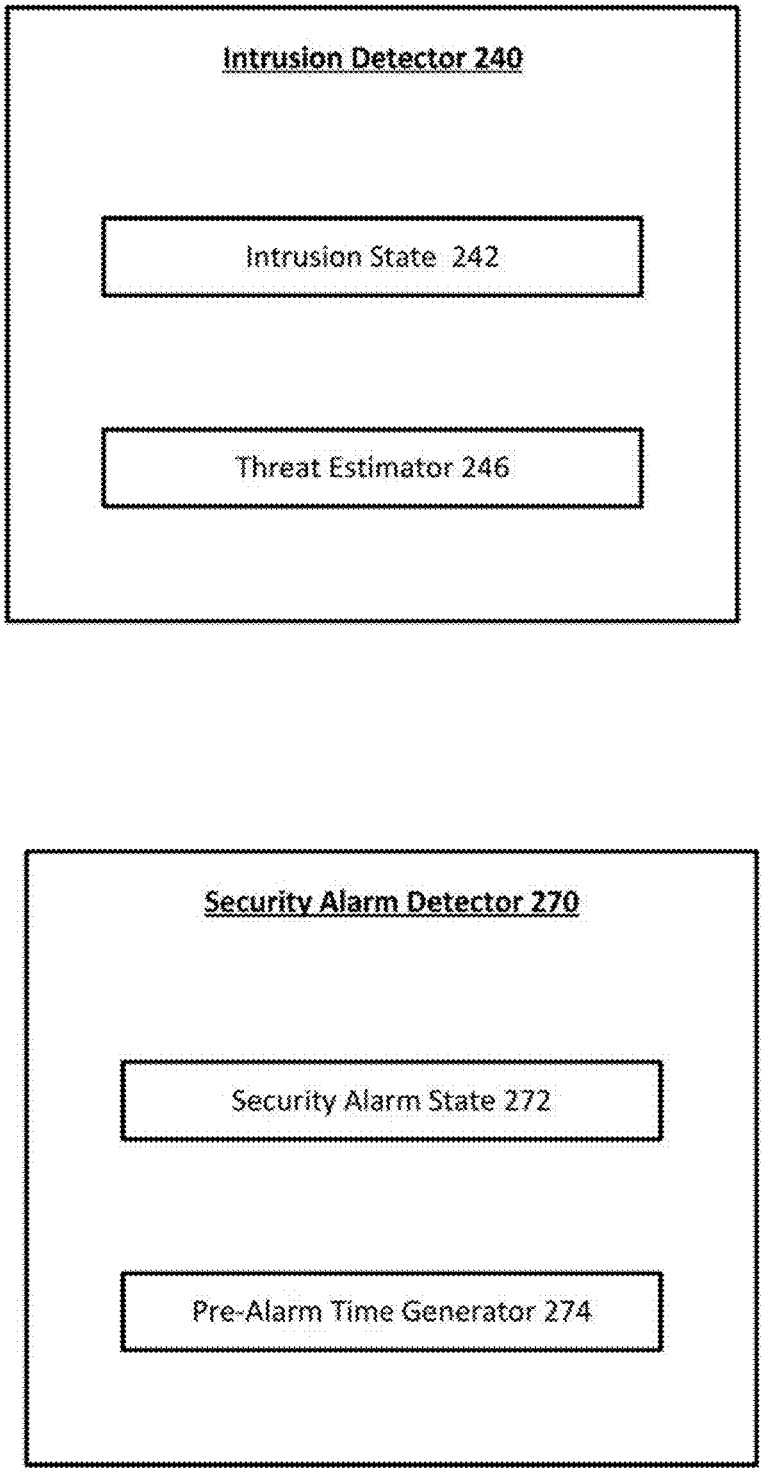
Figure 3:
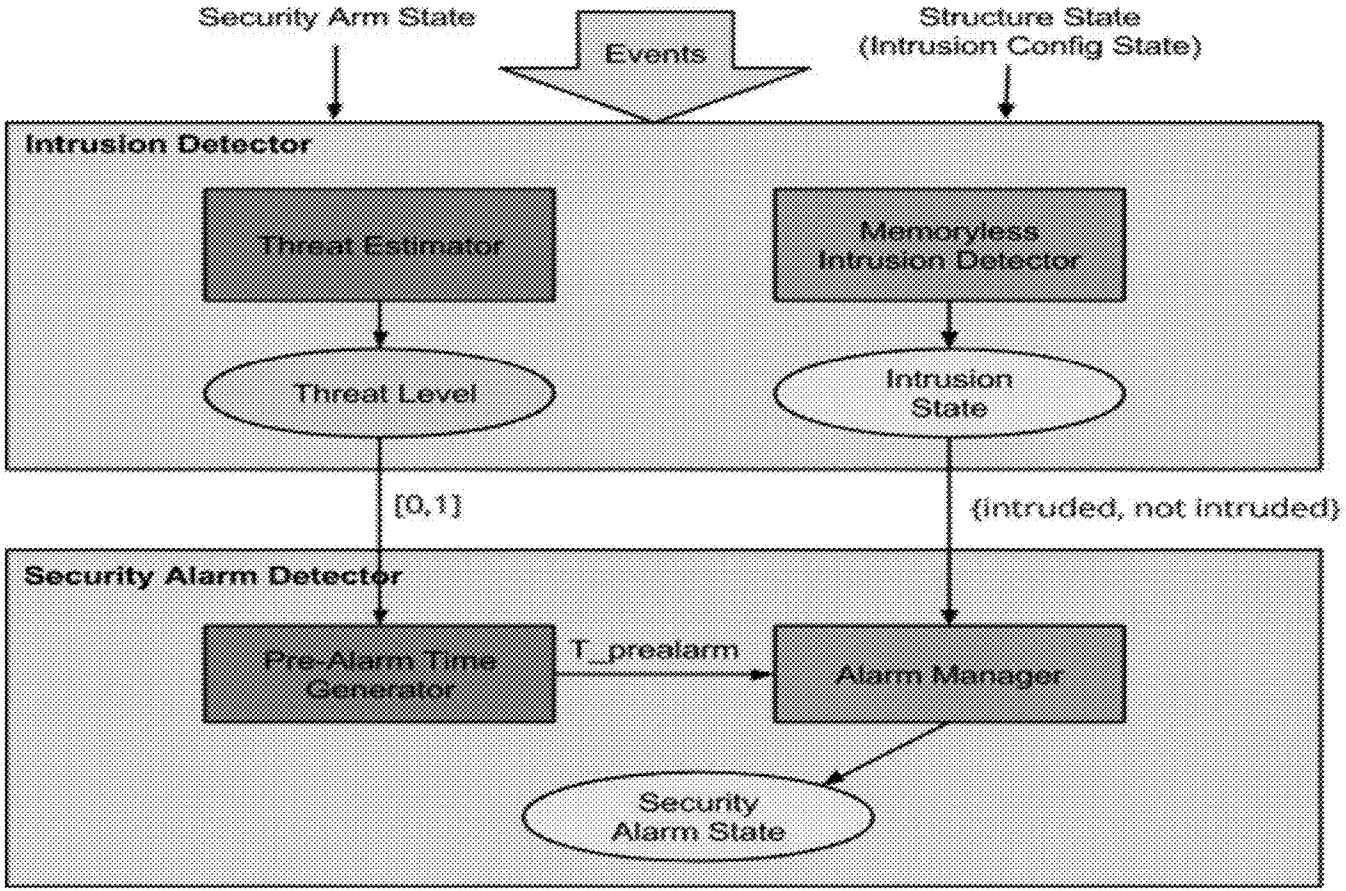
FIG. 3 shows devices and states of a security system according to an implementation of the disclosed subject matter.
Figure 7A:
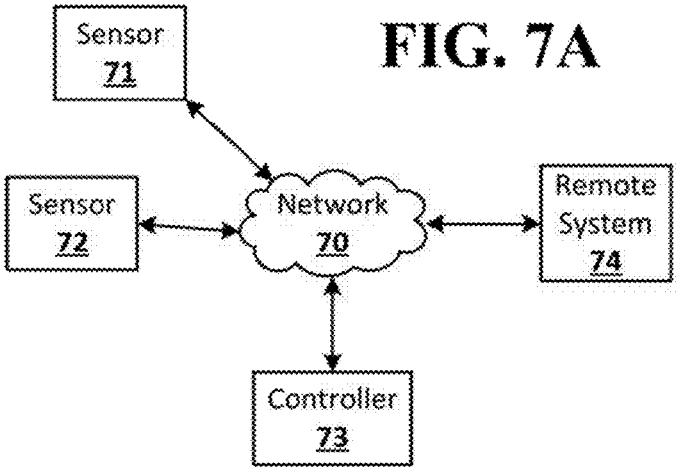
FIGS. 7A-7B show a security system having a sensor network according implementations of the disclosed subject matter.
Figure 7B:
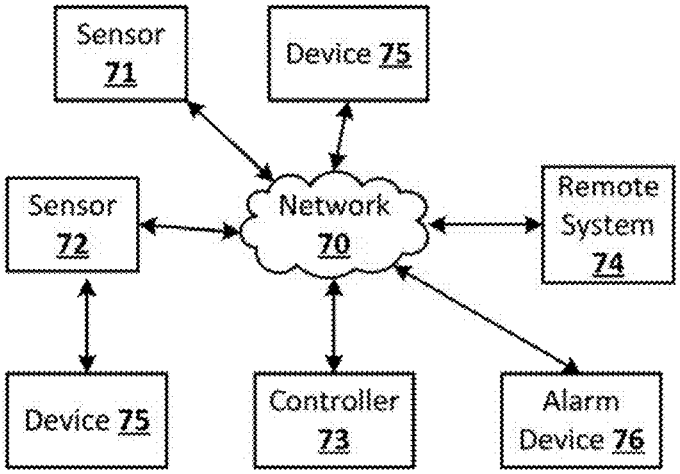

A threat estimator (e.g., threat estimator 246 of an intrusion detector 240 shown in FIGS. 2A-2B, and/or as part of the controller 73 of FIGS. 7A-7B) may determine a threat level according to the determined location of the entry. Determination of the threat level is discussed in detail below (e.g., at least in connection with FIG. 2B and FIG. 4). The method may include determining, by the threat estimator, the threat level at least based on a time of day. That is, a detected entry may have a higher or lower threat level according to the time of day. For example, a detected entry at night may have a higher threat level than a detected daytime entry. In another example, the threat level may be adjusted according to whether the entry is at a typical time of day that a user returns home (e.g., after work at 6 PM), or whether the entry is at an uncommon time (e.g., 10:30 AM on a weekday, or the like). The method may also adjust the pre-alarm time with a pre-alarm time generator (e.g., pre-alarm time generator 274 of security alarm detector 270) according to the determined threat level. That is, the determined threat level (e.g., that is determined by the threat estimator 246) may be an input value for the pre-alarm time generator so as to adjust the pre-alarm time. In some implementations, the pre-alarm time may be determined by the pre-alarm time generator according to a selection by a user.

In some implementations, an alarm manager (e.g., controller 73 shown in FIGS. 7A-7B) may determine the amount of time spent in a pre-alarm state and determining whether to control the alarm device to output an alarm. A controller of the security system may be coupled to and/or include a database of events, and the controller may determine whether the entry detected by the sensor is typical based on the database of events. The controller may adjust the pre-alarm time according to a determination of whether the detected entry is typical based on the database of events. The controller may determine whether one or more events after the detected entry is typical based on the database of events.

In some implementations, the processor may adjust the pre-alarm time according to the detection data received from at least one of a first sensor and a second sensor (e.g., sensors 71, 71 shown in FIGS. 7A-7B) that are included in the sensor. The controller may adjust the pre-alarm time differently for the first sensor and the second sensor. For example, the first sensor may be associated with a first entry to the home, and the second may be associated with a second entry to the home. Depending on which entry a person uses, the controller may adjust the pre-alarm time accordingly (e.g., to provide increased time or reduced time). The controller of the security system may adjust the pre-alarm time according to a sequence of events received from the first sensor and the second sensor.

FIGS. 2A-2B show a devices of a security system 200 of the smart home environment according to an implementation of the disclosed subject matter. The devices of the security system 200, as described below, may be integrated circuits, controllers, field programmable gate arrays, programmable logic unit, processors, or the like, and may, in some implementations, include software. The security system 200 may be part of controller 73 shown in FIGS. 7A-7B and discussed below, and/or may be communicatively coupled to the controller 73.

Security system 200 shown in FIG. 2A includes a disarming subsystem 210, an arming subsystem 212, a security arm injector 220, an intrusion configuration injector 230, an intrusion detector 240, a tamper detector 250, a system health detector 260, a security alarm detector 270, and an awareness detector 280.

The disarming subsystem 210 may enable a user to disarm the security system 200, and may include a keypad, touchscreen, display, and/or other suitable input device to receive a disarm command from a user. The disarming subsystem 210 may be communicatively coupled to the security arm injector 220, which may store the security arm state 222. Input received from the disarming subsystem 210 may change the security arm state 222. The arming system 212 may be separate from or may be integrated with the disarming subsystem 210. The arming subsystem 212 may receive an input from a user and/or a security system controller (e.g., controller 73 shown in FIGS. 7A-7B) to arm the security system 200. The security arm injector 220 and/or the intrusion configuration injector 230 may receive signals from the arming subsystem 212, and may determine whether or not to respectively change the security arm state 222 and/or an intrusion configuration 232.

The intrusion configuration injector 230 may store the intrusion configuration 232, which may define intrusions for the security system 200 and provide the configuration to the intrusion detector 240. For example, the intrusion configuration may define which doors may be typically used for entry, and which doors and/or windows may not typically be used for entry.

The intrusion detector 240 may store the intrusion state 242, which, as discussed below, may have two different states: (1) no intruder; and (2) intruder. That is, in some implementations, the intrusion detector 240 may determine whether a home has been intruded or not. The intrusion detector 240 may include a threat estimator 246, which as discussed below, may generate a threat level (e.g., between 0 and 1) according to the time and/or location of the intrusion. The open/close status detector 213 may receive data from a sensor (e.g., sensor 71, 72 of FIGS. 7A-7B) regarding whether a window and/or door has been opened, and may provide this data to the intrusion detector 240 (e.g., so that the intrusion state may be changed).

The tamper detector 250 may include a tamper state 252. The tamper detector 250 may determine if any of the sensors (e.g., sensors 71, 72 of FIGS. 7A-7B), such as those for doors and/or windows, may be displaced, altered, or the like. The tamper detector 250 may determine, according to the data received from the sensor, whether the sensor has been tampered with (e.g., by an intruder), or has merely fallen off or been dislodged by a non-intrusion related event), and may update the status of the tamper state accordingly (e.g., tamper, no tamper, or the like).

The system health detector 260 may include the health state 262. The system health detector 260 may determine if any of the sensors (e.g., sensors 71, 72 shown in FIGS. 7A-7B) is malfunctioning (e.g., is not providing data, is not receiving power, is not connected to the network, or the like), or whether the sensors are operating normally. The system health detector 260 may also determine whether the other devices of the security system 200 are operating normally. The system health detector 260 may update the health state 262 according to the determination of whether the sensors and devices of the security system 200 are operating normally or not.

Figure 4:
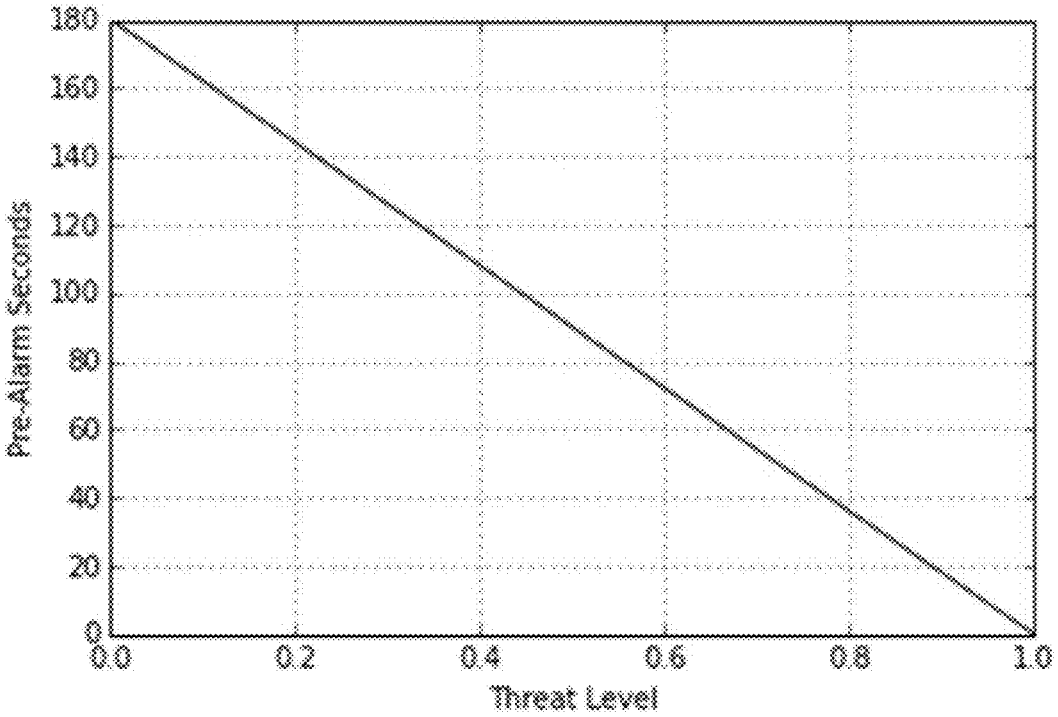
FIG. 4 shows a mapping of values of pre-alarm time and threat level according to an implementation of the disclosed subject matter.

The security alarm detector 270 may include a security alarm state 272. The alarm state may include whether an alarm is being output by the security system 200 or not, or whether the system is in a pre-alarm state. The security alarm detector 270 may include a pre-alarm time generator 274 that takes the threat level (e.g., from the threat estimator 246) as an input and may convert it into a time (i.e., a pre-alarm time). For example, the pre-alarm time generator may map threat level (e.g., having a value between 0 and 1) to a time (e.g., as shown in FIG. 4 and discussed below). Although FIG. 4 illustrates a linear mapping of the threat level to the time, the mapping may be non-linear in some implementations.

Figure 9:
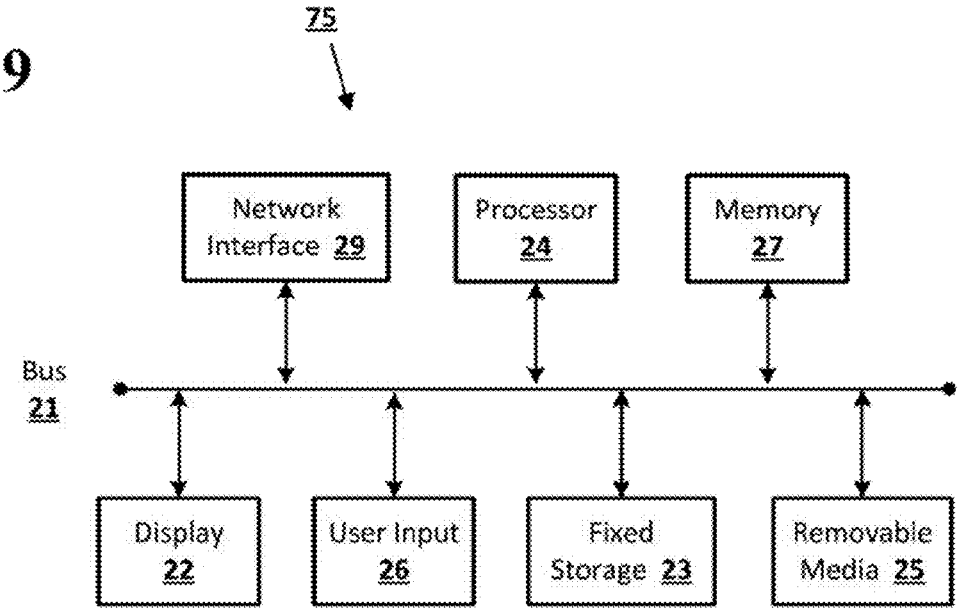
FIG. 9 shows an electronic device according to implementations of the disclosed subject matter.

The security system 200 may include an awareness detector 280, which may transmit notifications to the user (e.g., to device 75 shown in FIGS. 7A-7B and FIG. 9). For example, the notifications may indicate whether there is an intrusion. In another example, the notifications may indicate whether a particular state of the security system has changed (e.g., security arm state, intrusion configuration, intrusion state, open/close status, tamper state, security alarm state, health state, or the like).

In system 200, shown in FIGS. 2A-2B, the intrusion detector 240 may manage an intrusion state of the home. The intrusion state may be a number between 0 and 1 that represents the probability that there is an intruder in the home. That is, the closer that the intrusion state number is closer to 0, the less of a probability that there is that an intruder is in the home. As the intrusion state number approaches 1, the greater the probability that there is an intruder in the home. The intrusion detector 240, the tamper detector 250, and the system health detector 260 may provide data (e.g., the intrusion state, tamper state, and/or health state) to the security alarm detector 270. According to the received input, the security alarm detector 270 may control and/or update the security alarm state 272.

In some implementations, there may be two security states of the security system of the smart home environment. There are two security states: (1) a security arm state; and (2) a security alarm state. The security arm state (e.g., security arm state 222 of the security arm injector 220) may have two values: armed and unarmed. In implementations of the disclosed subject matter, "unarmed" means that the security system 200 of the smart home environment may not be monitoring the home for security events and/or breaches. "Armed" means that the security system 200 of the smart home environment is monitoring the home for security breaches at some level.

The security alarm state 272 stored by the security alarm detector 270 may have three values: No Alarm, Pre-Alarm, and Alarming. "No Alarm" may mean that there is no alarm currently (e.g., not alarm being output). "Pre-Alarm" may mean that the security system may have detected a security breach and/or security event and may transition to an alarming state (e.g., outputting an alarm) if no other action is taken by the user to disarm the alarm. The security system 200 may remain in a pre-alarm state for a pre-defined amount of time (e.g., that may be pre-set or which may be set by the user). There are requirements from, for example, agencies (e.g., Underwriter Laboratories (UL), the European Union (EU), etc.) that may determine the duration of pre-set time in order to be a certifiable home security system. "Alarming" may mean that the security system has detected a security event and/or breach and the alarm is being output (e.g., by alarm device 76 shown in FIG. 7B).

In implementations of the disclosed subject matter, there may be no "arming" state, as the security system 200 of the smart home environment may be either in an armed or unarmed state. That is, arming may be a special "Armed" state where the sensors are have a different intrusion configuration (e.g., as set in intrusion configuration 232). When a security event happens (e.g., a geofence exit) the intrusion configuration 232 of the sensors (e.g., sensors 71, 72) may change.

The intrusion configuration 232 of the security system 200 may determines how the home will be protected. The configuration 232 may be per-device. That is, each device may have a single intrusion configuration state that can be one of "Off," "Perimeter," "Full."

The intrusion configuration 232 for the security system 200 may look like Table 1 below, where the rows are the devices and the column is the intrusion configuration for the device. In some implementations, the sensor itself need not know the intrusion configuration state it is in. That is, in some implementations, only the controller and/or the intrusion configuration injector 230 of the security system 200 needs to know what the intrusion configuration is. The sensors may provide data and/or events to the controller, and the controller makes a determination according to the received data and/or events.

TABLE 1

| Device Name | Intrusion Configuration |
|---|---|
| Sensor #1 | Perimeter |
| Sensor #2 | Perimeter |
| Sensor #3 | Off |

In some implementations, macros may be defined in a security system controller for a security configuration state. The macros may be selectable from one or more default macros, and/or may be configured and/or modified by a user. For example, one macro may be for a "full" security configuration state (i.e., a "full" mode), which may configure the security system of the smart home environment to monitor events detected within a home and outside a home (e.g., within a predetermined perimeter of a home). In another example, a "perimeter" security configuration state (i.e., a "perimeter" mode) may configure the security system to monitor events at a predetermined perimeter of a home.

Devices (e.g., sensors) may be configured individually. The separate configurations per device may accommodate device-by-device inclusions or exclusions. For example, an exclusion may be used so as to arm a sensor for a particular window and/or door that is partially open to monitor events. In another example, an exclusion may be used to refrain from sending notifications and/or outputting an alarm with the movement of a pet.

The intrusion detector 240 shown in FIG. 2A may receive the security arm state 222 from the security arm injector 220 as an input, and the security configuration from the controller of the security system (e.g., controller 73 shown in FIGS. 7A-7B). Intrusion events (e.g., events 244 detected by the intrusion detector 240) may be received and/or input to the security alarm detector 270, which, in turn, may transition the security alarm state 272.

The security arm injector 220 and/or the intrusion configuration injector 230 may be hardware (e.g., electronic circuits, a processor, a controller, a programmable logic device, or the like), software, and/or a combination thereof. The security arm injector 220 and/or the intrusion configuration injector 230 may receive signals from one or more inputs (e.g., the disarming subsystem 210 and/or the arming subsystem 212), and may determine whether or not to respectively change the security arm state 222 and/or the intrusion configuration 232. FIG. 2A shows that that security arm injector 220 and/or the intrusion configuration injector 230 may provide one or more inputs to the intrusion detector 240.

The arm state (e.g., security arm state 222) and a structure occupancy state may be independent states. The arm state (e.g., security arm state 222) may be managed by the user or through an "arm automatically when away" feature of the security system. The structure occupancy state is managed by the security system 200. These two states interact by setting the intrusion configuration 232.

TABLE 2

| | Authorized Occupancy | Unauthorized Occupancy | Unoccupied |
|---|---|---|---|
| Unarmed | Unarmed Macro | Unarmed Macro | Unarmed Macro |
| Armed | Stay Macro | Away Macro | Away Macro |

When the security system 200 is unarmed (i.e., no matter what the structure occupancy), the intrusion detector 240 may be configured with an unarmed configuration macro. In some implementations, this may be a configuration where all the sensors are ignored. In some implementations, the security system may configure sensors on particular windows to alarm even in this state. For example, if you have an egress window in the basement that is rarely used, could be set to alarm even in the unarmed state.

In some implementations, there may be two separate occupied states: authorized occupancy and unauthorized occupancy. When the security system 200 is operating in a state with authorized occupancy and the system is armed, the intrusion configuration 232 of the system may be set to the stay macro. This may typically allow users to move freely within the home and exit through certain doors (e.g., preselected doors). If the security system 200 is operating in a state that includes the home being unoccupied and the system is armed, the intrusion configuration 232 of the system may be set to the away macro. This may typically be the most "locked-down" configuration. That is, this configuration may not allow perimeter events and/or occupancy events. Another state of the security system 200 may be one that includes unauthorized occupancy and the armed state. In this case, the system may operate in the away macro. If the user is actually home, the system can transition (e.g., automatically or at the request of a user) the state to authorized occupancy, and the system will not alarm. That is, the system may transition and operate in either the armed authorized occupancy state or the unarmed authorized occupancy state. Neither state will output an alarm when people are inside the home. If the person in the home is an intruder, then the system may operate in the away macro, and may output an alarm.

Described below are examples of the operation of system 200 when a user leaves the home, and then subsequently returns home.

As shown below in Table 2A, when the user is determined to be in the home, and the security arm state 222 is in the armed state, the security system may operate with the Stay macro.

TABLE 2A

| | Authorized Occupancy | Unauthorized Occupancy | Unoccupied |
|---|---|---|---|
| Unarmed | Unarmed Macro | Unarmed Macro | Unarmed Macro |
| Armed | Stay Macro | Away Macro | Away Macro |

When the user leaves the home, the security system 200 transitions an unoccupied state, as shown below in Table 2B. As the system is still armed, the system operates with an Away Macro which provides a stronger protection and/or security state than the Stay macro.

TABLE 2B

| | Authorized Occupancy | Unauthorized Occupancy | Unoccupied |
|---|---|---|---|
| Unarmed | Unarmed Macro | Unarmed Macro | Unarmed Macro |
| Armed | Stay Macro | Away Macro | Away Macro |

When the user returns home, the security system 200 may begin transition to an "occupied" state. As the user has not been authenticated, the system may operate in an Unauthorized Occupancy state, and the system may be armed. That is, as shown in Table 2C, the security system is still operating according to the away macro, so it may output an alarm according to a security event (e.g., detected motion, etc.). Typically, the user may set off the intrusion detector 240 when returning home and entering the house, and the system may enter the pre-alarm state.

TABLE 2C

| | Authorized Occupancy | Unauthorized Occupancy | Unoccupied |
|---|---|---|---|
| Unarmed | Unarmed Macro | Unarmed Macro | Unarmed Macro |
| Armed | Stay Macro | Away Macro | Away Macro |

When the user is authenticated by the security system 200 (e.g., by data provided by the user device 75, a key FOB, a security code, or the like to the security system), the detected occupancy may change from Unauthorized to Authorized. Depending on the authorization, the system may transition to the Unarmed Authorized Occupancy state or the Armed Authorized Occupancy state. For example, as shown in FIG.

4, the security system may transition to the Armed Authorized Occupancy state, which operates using the Stay Macro, as shown below in

TABLE 2D

| | Authorized Occupancy | Unauthorized Occupancy | Unoccupied |
|---|---|---|---|
| Unarmed | Unarmed Macro | Unarmed Macro | Unarmed Macro |
| Armed | Stay Macro | Away Macro | Away Macro |

The security system 200 may control whether the occupancy is authorized or not. The system may determine occupancy, and prompt the user to provide authentication (e.g., via device 75, a key FOB, a security code, or the like). The system may determine that the occupancy is unauthorized if the authentication credentials are not received within a predetermined period of time and/or the authentication credentials do not match stored credentials of an authorized user.

The intrusion configuration 232 of the intrusion configuration injector 230 may determine, at least in part, the security system experience for the user. With the security system of the smart home environment, the user may arm the security system of the home, and leave through a particular door, without setting off the alarm (e.g., causing the security system to output an alarm). Once the user leaves, the security system may secure the home.

Implementations of the disclosed subject matter may provide a security system with two arm states and two structure occupancy states. If a user is at home and the system is armed, it will allow the user to leave the home. When the security system determined that the user is away, the system may switch so as to be Armed and Away, which will turn on and/or operate according to the Away intrusion configuration macro. That is, in some implementations, there is no "countdown" when a user enters or exits a building before an alarm is armed or is output. That is, if the security system determines that a user is away, the security system may operate in a more secure state (e.g., a security setting to provide increased security).

The intrusion detector 240 may receive inputs from one or more sensors. In particular, the intrusion detector 240 may receive a signal and/or data from a sensor of an event when a door and/or window state changes (e.g., from closed to open, from open to closed, from closed to partially open, from partially open to closed, or the like). In some implementations, the sensor may provide data on the direction of movement of the door and/or window (e.g., opened from the inside, opened from the outside, unknown, or the like). It may also send whether the button was pressed before the open event.

In some implementations, a sensor that may be a motion detector may transmit data of an event when motion is detected (e.g., in a room, is a predetermined area, or the like) to the intrusion detector 240.

The controller of the security system 200 may query the intrusion detector 240 (e.g., at any time) to determine the intrusion state (e.g., intrusion state 242, which may be "no intruder" or "intruder," as discussed above). The intrusion state 242 may include a value between 0 and 1 that represents a probability of intrusion. That is, as the value approaches 0, the probability that there is an intrusion is reduced, and as the value approaches 1, the probability that there is an intrusion is increased.

The intrusion state 242 may be cleared from "intruder" (i.e., to no intruder) through the security arm injector 220. If the security arm state 222 of the security arm injector 220 is changed to "unarmed," then the intrusion detector 240 may receive a notification. In turn, the intrusion state 242 may be "cleared" back to "no intruder". This, in turn, will cause the alarm to cease being output. That is, the security alarm may be cleared through the intrusion detector 240 so as to increase consistency in the response of the security system. In this implementation, the alarm may be cleared because the change of the intrusion state 242.

In some implementations, the security system 200 may not consider what events were detected before the most recent detected event to make a determination on intrusion. The security system may consider each event without any knowledge of the previous events and determine whether to change the intrusion state. That is, in some implementations, the security system may refrain from alarming on a sequences of events (i.e., an impact, followed by open, followed by occupancy, and the like). The system may alarm immediately upon detection of the impact.

In implementations of the disclosed subject matter, the security system 200 may not consider when events are being received, but may only consider what the event is to make a decision regarding intrusion. That is, if the system considers the times of events, the system may observe, for example, that a particular window is infrequently opened (e.g., never opened), and decide that there is an intruder based on this anomaly versus the historical pattern. Alternatively, or in addition, false alarms may be minimized if the system "learns" that a door is typically opened at a particular time of the day and decides to refrain from outputting an alarm based on this historical pattern.

Events from a sensor (e.g., sensors 71, 72 shown in FIGS. 7A, 7B) may be transmitted to a controller of the security system 200 when a state changes. For example, an event may be sent when the sensor (e.g., sensor 71, 72) determines that the state of the door changes from closed to open (e.g., partially open, fully open, or the like). In some implementations, the controller may not store the previous state of the sensor. That is, the sensor may transmit data to the controller that includes the change state and the previous state (e.g., the previous state of the door, in this example).

Events in implementations of the disclosed subject matter may include one or more of the following fields: event type (e.g., open, close, motion, etc.), timestamp (e.g., 1:23 PM on 24-OCT-2014, and the like), WhatID (e.g., window, exterior door, and the like), WhoID (e.g., sensor 1, sensor 2, or the like), current state (e.g., open, partially open, or the like), previous state (e.g., closed, open, partially open, or the like), confidence (e.g., a number (to be determined) that corresponds to the confidence of the measurement, e.g., the raw passive infrared (PIR) value for the occupancy detector). The event may include metadata, such as inside, outside, configuration (e.g., orientation, height, occlusion, etc.), or the like.

The controller of the security system 200 may receive and/or access information in addition to the actual event. Such information may be divided into two categories: events and configurations. Events may be dynamic, and may be sent every time a sensor (e.g., sensors 71, 72 shown in FIGS. 7A-7B) identifies a change in its state. Configurations may be static, and may be typically set when the user installs a sensor.

The controller of the security system 200 may receive messages from sensors every time a change is detected by the sensor. The controller may access configuration data structures of the sensor (e.g., the sensor that transmitted the message to the controller), as well as from other sensors in the home.

The controller of the security system 200 may control arming and disarming. The controller and/or the intrusion detector 240 may take probability as an input, and be responsive to historical patterns to find anomalous occupancy. The controller may change the thresholds for all the sensors by using a learning algorithm. The controller may account for the detected movement of pets using cross-sensor correlation and an automatic sensitivity adjustment.

The controller may include circuitry, software, or a combination thereof to implement an intrusion detection algorithm, which may include a rules-based engine. Several considerations may be made by the rules engine. For example, the rules engine may consider the security state, and may only be enabled when the security system is armed. The rules engine may also consider the intrusion configuration of each sensor, which may, for example, have a configuration setting for "off," "perimeter," and/or "full." The rules engine may consider the event type, such as open, close, device motion (e.g., motion detected by a sensor), occupancy motion (e.g., motion of a user within the home, or the like), fault (e.g., a sensor is not operating normally, has been dislodged, or the like), and/or event metadata (e.g., open from inside, open from outside, close form inside, close from outside, or the like). The rules engine may consider a trustworthiness score, which may be a number between 0 and 1, and may correspond to an event itself, or to some metadata within the event. For example, the score may correspond to occupancy or to an inside or outside decision. In some implementations, the score may relate to whether the sensor calibration recently been changed, whether the data from the sensor been correlated with other data from nearby sensors, or the like. The score may be a function of many factors such as, for example, sensor install height (e.g., above 6 ft, below 6 ft., or the like); sensor orientation (e.g., horizontal, vertical, or the like); sensor occlusion (e.g., occluded, not occluded); structure configuration (e.g., no pets, small pets, large pets, small children, or the like); sensor identification (ID) (e.g., window sensor, door sensor, garage door sensor, or the like), sensor window type ID (e.g., single-hung window, double-hung window, casement window, or the like); sensor door type ID (e.g., sliding door, French door, exterior swing door, or the like), sensor location ID (e.g., living room, bedroom, hallway, or the like); and/or historical false alarms from the sensor. For example, if the sensor height is less than 4 ft., and there are pets in the home, the inside/outside decision may not be trusted, so the controller of the security system may ignore it.

In some embodiments, the controller may generate and/or consider an event confidence score, to determine whether the event detected by the sensor actually occurred, or whether it is an error. For example, the event confidence score may be increased according to similar detection be sensors within a predetermined area from a particular sensor.

In some implementations, the security system 200 may return feedback to a user on the status of all doors and/or windows in the home (e.g., open/close status 213 shown in FIG. 2A). The status of sensors that detect the open and close status of a door or window may be input (e.g., input 214). In some implementations, the controller may include support for exceptions and overrides (e.g., arming a home when there is a window/door open). The open/close status detector 213 may provide a list of open doors and/or windows to the user (e.g., via device 75 or the like). When arming the security system, the open/close status detector 213 may know how many times the user overrode and/or armed the system for each open/close combination. The intrusion detector 240 may not need to receive open and/or close date from a sensor directly. Instead, the intrusion detector 240 may detect changes in the state of the open/close status detector 213. The security system may output an alarm when the state of the open/close status detector 213 changes while armed.

Implementations of security system 200 discussed above may reduce the number of false alarms. That is, the number of alarms output by an alarm device (e.g., alarm device 76 may be reduced (e.g., not the heads-up/pre-alarm). Typically, most false alarms occur when the user attempting entering their own home.

Implementations of the security system 200 discussed above may reduce the delay in alarming on actual intrusions. That is, the faster the security system 200 alarms, the less time intruders will be in a user's home, and the more likely that law enforcement and/or security services may apprehend them.

Security system 200 of the smart home environment may be controlled and/or operated so as to make it as predictable as possible to the end user.

The pre-alarm time of security system 200 may be bounded between a minimum value and a maximum value. As an example, the maximum pre-alarm time may be 180 seconds (i.e., 3 minutes) and the minimum pre-alarm time may be zero (0) seconds (i.e., an instant alarm).

The security system 200 may include diagnostics (e.g., that are performed automatically and/or periodically by the system, and/or are performed at the request of a user). For example, the system may determine the number of false alarms (i.e., where an alarm device 76 outputs an alarm) when the user arrives home. In some implementations, by training the security system 200, the number of false alarms may be reduced. For example, a user may provide input to the security system 200 so as to label which alarms were false alarms and which were actual intrusions.

The security system 200 may be learn whether a user is rushed in disarming the alarm when arriving home. For example, a user interface of the security system (e.g., device 75 shown in FIGS. 7A-7B) may survey a user to determine whether the user feels rushed in attempting to disarm. That is, although there may be few false alarms, a user may still be rushing to disarm the security system. Based on the user survey, the system may gradually increase the pre-alarm time (e.g., over a one-week period, over a period or several weeks, or the like) so that the user does not feel rushed.

The security system 200 may consider the time until full alarm on actual intrusion, and may make this time as small as possible (e.g., so that an alarm may be output and law enforcement may be contacted as soon as possible). For example, the system may be pre-loaded with data that model break-ins. This data may be used to detect an actual intrusion and to reduce the pre-alarm time when the actual intrusion is detected.

As shown in FIG. 2B, the security system 200 of the smart home environment may include a threat estimator 246 and a pre-alarm time generator 277. The threat estimator 246 may be a sub-system of the intrusion detector 240 that takes the events, the security arm state, and the structure state (e.g., the intrusion configuration) and estimates a threat level. The value of a threat level may a number between 0 and 1, with 0 being no threat and 1 being a very high threat. The pre-alarm time generator 274 may be a sub-system of the security alarm detector 270 that takes the threat level as an input and converts it into a time. For example, the pre-alarm time generator 274 may map threat level (e.g., having a value between 0 and 1) to a time (e.g., as shown in FIG. 4). The Intrusion Detector 240 may make a binary decision regarding whether the home is intruded or not.

The security alarm detector 270 (and/or controller of system 200) may determine how long it is in the pre-alarm state and may determine whether or not to change to full alarm. The time for pre-alarm may be variable. According to events received by the security system 200, the system may shorten or lengthen the pre-alarm time. The security alarm detector 270 may handle the variable time of the pre-alarm. For example, if the alarm is first tripped with 60 seconds of pre-alarm, and after 30 seconds, the pre-alarm time changes to 40 seconds, the alarm may be output 10 seconds later. That is, the most recent pre-alarm time is determinative, where the pre-alarm time is counted from when the pre-alarm time is first entered.

In some implementations, there may be a single pre-alarm time for all alarms. That is, the threat estimator 246 may always output 0.75 (i.e., constantly) regardless of the event, structure state, or arm mode.

The pre-alarm time generator 274 may be implemented as a linear function that maps threat level to time (see, e.g., FIG. 4). The function may be:

$$T_{prealarm}=T\max*(1-\text{threatlevel})$$

where $T_{prealarm}$ is the pre-alarm time, Tmax is the maximum pre-alarm time, and threatlevel is a threat level value between 0 and 1. In some implementations, the user may choose their own Tmax with a default choice 180 seconds (i.e., 3 minutes). This value may also be the maximum. The user may have an option to make the home more secure if they so wish (e.g., by reducing Tmax). The highest threat level of 1 may map to 0 seconds of pre-alarm. The lowest threat level of 0 may map to 180 seconds (e.g., 3 minutes) of pre-alarm. This lowest threat level pre-alarm time is merely an example, and the time may be different (e.g., 150 seconds, 165 seconds, 190 seconds, 200 seconds, 225 seconds, or the like). All the values in between may map linearly. FIG. 4 shows a graph of the linear functions. With a constant 0.75 threat level, the pre-alarm time may be a fixed 45 seconds for all alarm triggering events. Although the example implementation discussed above is directed to a linear mapping, there may be implementations of the disclosed subject matter that may be a non-linear mapping of the threat level to time.

In some implementations of the disclosed subject matter, the threat estimator 246 may have a different threat level for every initial trigger. For example, some implementations may have two threat levels: 0.9 for threatening events (e.g., 18 seconds of pre-alarm), and 0.5 for non-threatening events (e.g., 90 seconds of pre-alarm). The threat estimator 246 may assess if an event is threatening or not based on a lookup table. An example lookup table is shown as Table 3 below.

TABLE 3

| Arm/Structure State | Initial Trigger | Threat Level |
|---|---|---|
| AWAY + ARMED | Entry Door Open | 0.5 low threat |
| AWAY + ARMED | Non Entry Open or PIR Motion | 0.9 high threat |
| HOME + ARMED | Door open with significant PIR motion on the inside before, e.g. likely an inside open. | 0.5 low threat |

TABLE 3-continued

| Arm/Structure State | Initial Trigger | Threat Level |
|---|---|---|
| HOME + ARMED | Door open with no PIR motion on inside before, e.g. likely an outside open. | 0.9 high threat |

In some implementations, the threat estimator 246 may include memory and/or a data storage device. That is, the threat estimator 246 may store events, such as geofence (e.g., whether a user device 75 has traversed a preset geofence) and Bluetooth Low Energy (BLE) events (e.g., communication of data from a user device 75 to the system) detected by the security system 200, when the system in ARMED and in AWAY mode. In this implementation, the security system 200 may consider whether BLE is enabled, whether geofencing is enabled, whether one or more of the entry doors are protected, whether none of the entry doors are protected, and/or whether a garage door is protected.

In a typical implementation, the BLE and geofencing may be enabled, and all of the entry doors may be protected.

In some implementations, there may be, for example, eight (8) trigger sequences of what can happen when a person (i.e., user) comes home and the security system is ARMED and AWAY. Table 4A below lists the trigger sequence events and example threat levels.

TABLE 4A

| Geofence Entry within 90 seconds of Initial Trip | Initial trip of alarm | BLE Authorization within 30 seconds of initial trip of alarm | Threat Level |
|---|---|---|---|
| 0 | Non Entry Door/Motion | 0 | 1.0 This is what a burglar would look like. |
| 0 | Non Entry Door/Motion | 1 | 0.9 Initial entry not through expected door. |
| 0 | Entry Door | 0 | 0.5 Could be a burglar coming through entry door. Could also happen if user's device is dead. |
| 0 | Entry Door | 1 | 0.25 Could happen if device misses geofence event for some reason. |
| 1 | Non Entry Door/Motion | 0 | 0.9 Initial entry not through expected door. |
| 1 | Non Entry Door/Motion | 1 | 0.9 Initial entry not through expected door. |
| 1 | Entry Door | 0 | 0.35 Could happen if bluetooth (BLE) is off or entrance is far away from sensor. |
| 1 | Entry Door | 1 | 0.01 Typical signature of user coming home. Extremely low threat level. |

In another example, the security system 200 may enable geofencing and BLE, but not all entry doors may be protected. Table 4B below lists the trigger sequence events and threat levels in this example.

TABLE 4B

| Geofence Entry within 90 seconds of Initial Trip | Initial trip of alarm | BLE Authorization within 60 seconds of initial trip of alarm | Threat Level |
|---|---|---|---|
| * | Entry Door | * | see Table 4A above |
| * | Non Entry Door | * | 0.9 Initial entry not through expected door |

TABLE 4B-continued

| Geofence Entry within 90 seconds of Initial Trip | Initial trip of alarm | BLE Authorization within 60 seconds of initial trip of alarm | Threat Level |
|---|---|---|---|
| 0 | Motion | 0 | 0.75 Could be burglar, or could be user with dead phone. Higher than using marked entry door by 0.25 |
| 0 | Motion | 1 | 0.5 Higher than using marked entry door by 0.25 |
| 1 | Motion | 0 | 0.65 Higher than using marked entry door by 0.25 |
| 1 | Motion | 1 | 0.25 Typical signature of user coming home. Higher than using marked entry door by 0.25. |

When not all doors and/or windows are protected by a sensor, detected motion may be an allowable initial trip. In this implementation, the threat level may be increased, for example, by 0.25, since the system may not be able to determine whether the detected person came in through an entry door. That is, compared to an actual entry door detected event, 0.25 may be added to the threat level if all entry doors are not protected and the detected motion is acceptable. If there is an actual non-entry door open, the security system 200 may treat it like a non-entry door open event, and may classify it as a high threat open.

In another example, the BLE detection by the security system 200 may be enable, all of the entry doors may be protected (e.g., a sensor may detect opening and/or closing of a door), but the system may not receive and/or consider geofence data. Table 4C below lists the trigger sequence events and threat levels for this example.

TABLE 4C

| Geofence Entry within 90 seconds of Initial Trip | BLE Authorization within 60 seconds of initial trip of alarm | Threat Level |
|---|---|---|
| Entry Door | 0 | 0.6 Could be burglar or user's device could be dead. Assuming geofence = 0 and adding 0.1 to that threat level. |
| Entry Door | 1 | 0.35 Typical value, but can't get to zero because geofence turned off. Assuming geofence = 0 and adding 0.1 to that threat level. |
| Non Entry Door or Motion | 0 | 1.0 Initial entry not through expected door and no BLE |
| Non Entry Door or Motion | 1 | 1.0 Initial entry not through expected door. Adding 0.1 to threat level if there is no geofence rails us at 1.0 |

In implementations of the disclosed subject matter, when either geofencing or BLE is not enabled (e.g., turned off), the security system 200 may assume a threat level of 0. Depending upon circumstances, a factor may be added to the threat level, saturating at 1.0 (e.g., the highest example threat level). The security system 200 may determine the additive factors. For example, when the geofence is off (e.g., geofence detection is not enabled, etc.), the system may assume geofence always false, and add 0.1 factor to threat level. When the BLE is off (e.g., BLE detection is not enabled, etc.), the security system 200 may assume the BLE is always false, and add 0.2 factor to threat level.

Figure 5:
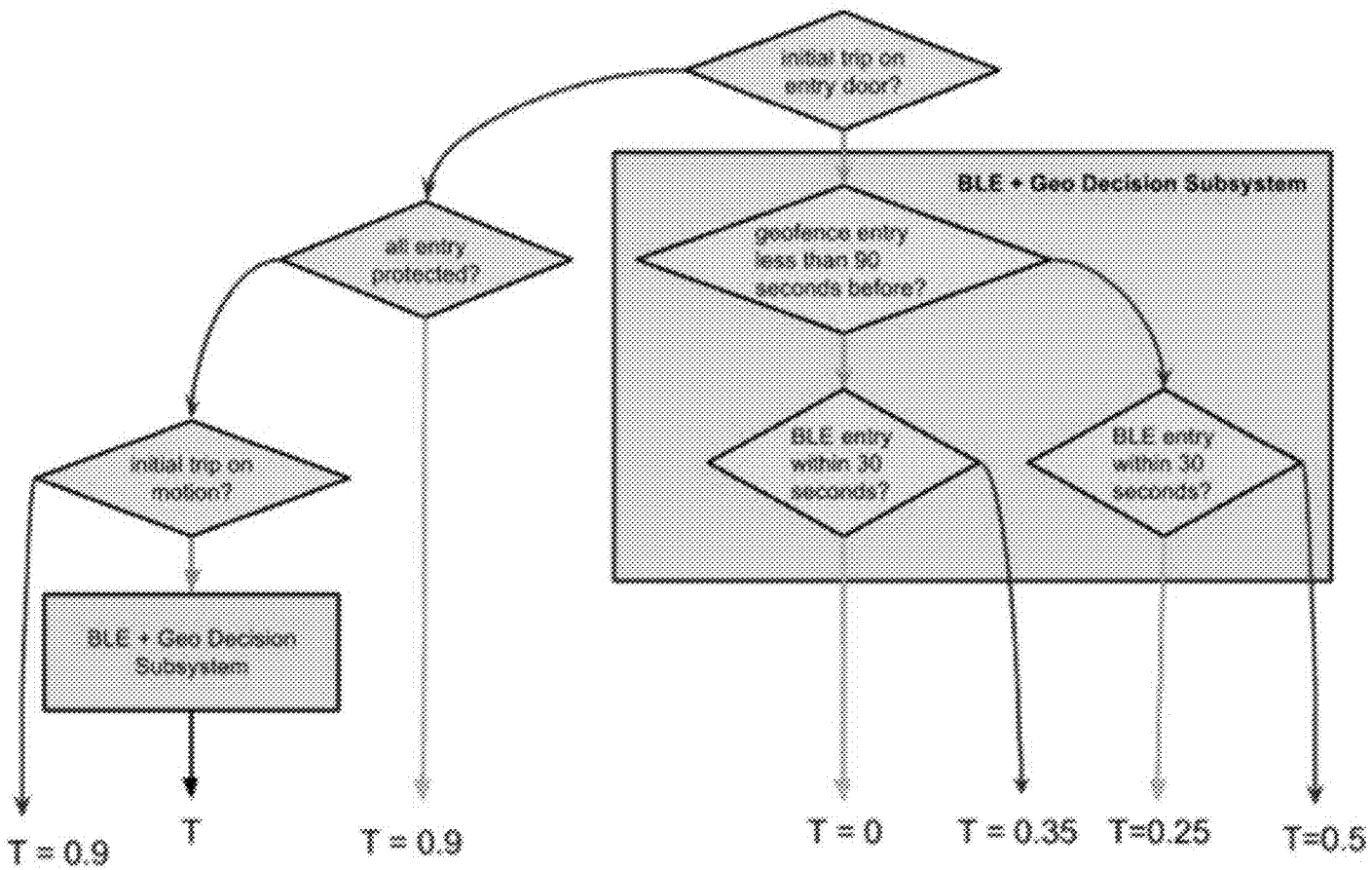
FIG. 5 shows a flowchart of threat levels and additive offsets for the security system according to an implementation of the disclosed subject matter.

FIG. 5 shows a flow chart for threat levels and "additive offsets" in implementations of the disclosed subject matter that are used to modify the threat level. In FIG. 5, if geofencing or BLE is not enabled, it is assumed the answer is "no" at that decision point in the flow chart. The "raw" threat level that comes out of the flowchart shown in FIG. 5 may be modified by "additive offsets," given certain conditions. The disclosed offsets above and in FIG. 5 are merely examples, and other suitable values for offsets may be selected, such as those shown below in Table 5.

TABLE 5

| Configuration | Additive Threat Offset |
|---|---|
| Geofence Off | DT = 0.1 |
| BLE Off | DT = 0.2 |
| Entry Doors Not All Protected | DT = 0.25 (add to threat level if motion is initial trigger) |

A user may be more "rushed" if the security system 200 is not enabled for BLE and geofencing. BLE and geofencing are features that the system may use to increase the accuracy of the determination that the person entering the home is an authorized user. If a user does not enable these features, the system may be less sure when an entry is made, so the system may err on the side of caution and alarm faster. When a user enables the BLE and geofencing, the user experience with the security system 200 may be improved.

In some implementations of the disclosed subject matter, the security system 200 may adapt the pre-alarm time as the system learns about the user's patterns. The system may learn the pre-alarm times for all the different doors and windows (e.g., instead of hardcoding them and/or requesting user input for them). By learning the pre-alarm times, the system may shorten the time to full alarm, in case of a real intrusion. By learning the pre-alarm time, the system may reduce false alarms by lengthening the time to accommodate a particular user. The system may start the pre-alarm time at the longest time (e.g., 3 minutes) for the low threat entries. In some implementations, there may be an option where this adaptation goes beyond 3 minutes.

In the security system 200, there may be a separate pre-alarm time for every initial trigger. In some implementations, there may be a continuously varying pre-alarm time for every initial trigger. For example, there may be 2 seconds for the window, 72 seconds for the front door with geofence and BLE, and 99 seconds for the garage door with geofence and BLE. For increased predictability, the system may have a few quantized pre-alarm times that each of the pre-alarm times must map to.

The system may store a history of recent times to disarm for every initial trigger of the pre-alarm that is eventually disarmed by the user. That is, the system may include all data that is not an actual intrusion, i.e., where the alarm was eventually disarmed by the user because it was not a real intrusion. In some implementations, the pre-alarm time may be adapted weekly so that it is as short as possible without causing unnecessary false alarms.

An initial trigger may be an initial event that tripped the alarm (e.g., alarm device and/or security system) and the relevant geofence and/or BLE metadata. Initial triggers may be keyed by device, event, and/or arm/structure mode. In some implementations, only initial triggers that trip the alarm may be determined and/or stored. For example, when the security system is operating in stay mode, motion does not need to be determined because it never trips the alarm. For some of the initial triggers, the geofence and BLE may not need to be enabled for the system. This may true for all the STAY mode triggers of the security system.

The security system may consider "recent" times, such that the security system does not consider the entire history of an initial trigger, but rather events within a pre-defined window of time. For example, the window of time may be 60 days. Patterns may change over time, and by having the security system consider the history of the pre-defined window, the system may operate according to the most recent adaptations (e.g., the most recent patterns that are used to adjust the pre-alarm time).

Table 6 below shows an example history of a home events:

TABLE 6

| Armed Structure Mode | Device | Event | Geofence entry < 90 seconds before event? | BLE entry within 30 seconds of event? | Time until Disarm in last 60 days |
|---|---|---|---|---|---|
| ARMED + AWAY | Front Door Sensor | Open | Y | Y | 74, 73, 99, 81, 110, . . . |
| ARMED + AWAY | Front Door Sensor | Open | N | N | 75, 89, . . . |
| ARMED + AWAY | Front Door Sensor | Motion | — | — | none |
| ARMED + HOME | Front Door Sensor | Open | n/a | n/a | 23, 29, 44, 12, 23, . . . |
| ARMED + AWAY | Garage Door Sensor | Open | Y | Y | 45, 41, 34, 22, 67, . . . |
| ARMED + AWAY | Garage Door Sensor | Motion | — | — | none |
| ARMED + HOME | Garage Door Sensor | Open | n/a | n/a | 44, 46, 75, 23, 83, 44 |
| ARMED + AWAY | Living Room Sensor | Motion | — | — | none |
| etc . . . | | | | | |

For each initial trigger, the security system 200 may take the maximum over all the disarm times, add some margin to it, so as to form a pre-alarm time for that particular initial trigger. In some implementations, the pre-alarm time may be adapted directly, and other implementations may adapt the pre-alarm time to the threat level.

The security system may have the threat estimator 246 compute the time directly and provide it to the security alarm detector 270. Alternatively, the security system 200 may have the threat estimator 246 provide the threat level and the maximum pre-alarm time to the security alarm detector 270. By providing both the maximum pre-alarm time and the threat level, other subsystems may use the output from the threat estimator 246.

In some implementations, the threat estimator 246 may compute the maximum pre-alarm time for the initial trigger as:

$$T_{prealarm\text{-}max}=\max(\mathrm{vec}(T_{disarm}))+T_{margin}$$

For example, the security system may begin with a Tmargin equal 15 seconds, where Tmargin is the additional time added to a pre-alarm time so that a user does not feel rushed. Tprealarm-max (i.e., the pre-alarm time that is the computed maximum pre-alarm time from the time to disarm and the additional margin) may go into a linear function of the pre-alarm time generator for that event as:

$$T\text{prealarm}=T\text{prealarm-max}*(1-\text{threatlevel})$$

Here, $T_{prealarm}$ may be the pre-alarm time, and threatlevel may be a value between 0 and 1. In some implementations, a non-linear function may be used to generate pre-alarm time. The security system may perform this computation on any schedule (e.g., every hour, every day, once a week, once a month, or the like). The security system may regularize the maximum computation to make the behavior more stable. For example, if a particular initial trigger is never seen then Tprealarm-max is set to 0. A single, predetermined time (e.g., that is great than a particular length of time) until disarm can set Tprealarm-max to a higher value. That is, the system may err on the side of reducing false alarms. When particular disarm times (e.g., those that are greater than a particular length) are outside the recent predetermined time window, the system may not immediately lower time. In some implementations, the system may slowly and/or gradually change the time (e.g., over one or more weeks) toward the lower value. For example, the system may reduce the time by five (5) seconds every week. By doing so, the system may err on the side of reducing false alarms.

In some implementations, other functions and/or equations may be used in place of those of the implementations disclosed above.

The security system 200 may automatically learn static configurations of the home using historical data. That is, rather that the user providing input to the system about entry doors, and whether all the entry doors have a sensor, the system may automatically learn this by gathering data regarding detected initial trigger events. In some implementations, the system may have a "learning period" to learn what typical initial triggers are and to set these initial trigger to a low threat level. The system may then set all other initial triggers to a high threat level.

The security system 200 may set different pre-alarm times depending on who is coming home. For example, a first person may receive more time than a second person (e.g., a grandma may receive more time than a teenager). The system may include sensor models (e.g., stored in a database and/or a memory) to do time-of-day adaptations to pre-alarm time. For example, a user may receive more time to disarm if the user comes home at a typical time (e.g., 5 PM, after work) than an atypical time (e.g., 11 AM on a weekday).

In some implementations, the system may generate and/or store sensor models to do full sequence anomaly detection. That is, the system may consider all the events after an initial trigger event to determine if the activity detected in the home is typical or atypical. In some implementations, the security system may use a sequence anomaly detection to determine whether the event is typical or atypical.

The security system 200 may integrate with other device and/or software. For example, the user may have a particular application on the user device (e.g., device 75) which determines the position and/or location of the user. This data may be provided to the security system 200 so as to adjust the pre-alarm time. For example, if the security system 200 knows that a user is coming back home from the grocery store according to the received data, the security system may increase the pre-alarm time (e.g., so that the user has enough time to disarm the alarm while carrying groceries and the like). The user device and/or car may receive input from the user that the user intends to return home, this data may be used to increase the pre-alarm time.

Implementations of the security system 200 may include options to manage user privacy. Sensors of the security system 200 (e.g., sensors 71, 72) may capture images, motion data, sound, and the like, and the system may capture BLE and/or geofencing data. That is, location information, image data, motion data, sound data, arrival and/or departure times may be detected by the security system and/or may be stored. A user may manage the collection and/or storage of user-related data of the security system. For example, a user may use the controller 73 and/or the device 75 (e.g., as shown in FIGS. 7A-7B) to manage the collected data. An interface of the controller 73 and/or device 75 may receive one or more inputs from the user to control the collection of data (e.g., control whether image data and/or sound data is captured, and, if it is captured, whether it should be stored and/or linked to a particular user). The interface may receive input from a user to purge and/or delete any identifying information and/or non-personally identification information (e.g., captured motion data, BLE data, geofence data, or the like). In some implementations, the user may select to purge and/or delete any identifying information and/or non-personally identification information periodically (e.g., once a day, once a week, once a month, every six months, every year, or the like). The user may select to retain at least a portion of captured identifying information and/or at least a portion of the captured non-personally identification information. In some implementations, the interface may receive input from a user to anonymize any identifying information (e.g., captured image data, sound data, or the like) so that it is not linked to a particular user.

Implementations of the security system 200 may be part of a smart home environment that uses one or more sensors. In general, a "sensor" may refer to any device that can obtain information about its environment. Sensors may be described by the type of information they collect. For example, sensor types as disclosed herein may include motion, smoke, carbon monoxide, carbon dioxide, laser, sound, proximity, temperature, time, physical orientation, acceleration, location, entry, presence, and the like. A sensor can include, for example, a camera, a retinal camera, a passive infra-red (PIR) sensor, an active infra-red (AIR), and/or a microphone.

A sensor also may be described in terms of the particular physical device that obtains the environmental information. For example, an accelerometer may obtain acceleration information, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combinations thereof. A sensor also may be described in terms of a function or functions the sensor performs within an integrated sensor network, such as a smart home environment as disclosed herein. For example, a sensor may operate as a security sensor when it is used to determine security events such as unauthorized entry. A sensor may operate with different functions at different times, such as where a motion sensor is used to control lighting in a smart home environment when an authorized user is present, and is used to alert to unauthorized or unexpected movement when no authorized user is present, or when an alarm system is in an "armed" state, or the like. In some cases, a sensor may operate as multiple sensor types sequentially or concurrently, such as where a temperature sensor is used to detect a change in temperature, as well as the presence of a person or animal. A sensor also may operate in different modes at the same or different times. For example, a sensor may be configured to operate in one mode during the day and another mode at night. As another example, a sensor may operate in different modes based upon a state of a home security system or a smart home environment, or as otherwise directed by such a system.

In general, a "sensor" as disclosed herein may include multiple sensors or sub-sensors, such as where a position sensor includes both a global positioning sensor (GPS) as well as a wireless network sensor, which provides data that can be correlated with known wireless networks to obtain location information. Multiple sensors may be arranged in a single physical housing, such as where a single device includes movement, temperature, magnetic, and/or other sensors. Such a housing also may be referred to as a sensor or a sensor device. For clarity, sensors are described with respect to the particular functions they perform and/or the particular physical hardware used, when such specification is necessary for understanding of the implementations disclosed herein.

A sensor may include hardware in addition to the specific physical sensor that obtains information about the environment. FIG. 6 shows an example sensor as disclosed herein. The sensor 60 may include an environmental sensor 61, such as a temperature sensor, smoke sensor, carbon monoxide sensor, motion sensor, accelerometer, proximity sensor, passive infrared (PIR) sensor, magnetic field sensor, radio frequency (RF) sensor, light sensor, humidity sensor, or any other suitable environmental sensor, that obtains a corresponding type of information about the environment in which the sensor 60 is located. A processor 64 may receive and analyze data obtained by the sensor 61, control operation of other components of the sensor 60, and process communication between the sensor and other devices. The processor 64 may execute instructions stored on a computer-readable memory 65. The memory 65 or another memory in the sensor 60 may also store environmental data obtained by the sensor 61. A communication interface 63, such as a Wi-Fi or other wireless interface, Ethernet or other local network interface, or the like may allow for communication by the sensor 60 with other devices.

A user interface (UI) 62 may provide information (e.g., via a display device or the like) and/or receive input from a user of the sensor. The UI 62 may include, for example, a speaker to output an audible alarm and/or message when an event is detected by the sensor 60. The speaker may output a message to an authorized user regarding the operational status (e.g., there are no security and/or environmental events, an operational issue has been detected, and/or a security event and/or environmental event has been detected) of the security system disclosed herein, when, for example, the user arrives at the building (e.g., the user's home, the user's office, or the like), or when the user exits the building. The speaker may output an audible message for a user to access information regarding the operational status of the security system, for example, when the user arrives at the building (e.g., a home, an office, or the like) via an application installed and/or accessible from an electronic device (e.g., device 75 illustrated in FIG. 7B and/or FIG. 9). Alternatively, or in addition, the UI 62 may include a light to be activated when an event is detected by the sensor 60. The user interface may be relatively minimal, such as a limited-output display, or it may be a full-featured interface such as a touchscreen.

Components within the sensor 60 may transmit and receive information to and from one another via an internal bus or other mechanism as will be readily understood by one of skill in the art. One or more components may be implemented in a single physical arrangement, such as where multiple components are implemented on a single integrated circuit. Sensors as disclosed herein may include other components, and/or may not include all of the illustrative components shown.

Sensors as disclosed herein may operate within a communication network, such as a conventional wireless network, and/or a sensor-specific network through which sensors may communicate with one another and/or with dedicated other devices. In some configurations, one or more sensors may provide information to one or more other sensors, to a central controller, or to any other device capable of communicating on a network with the one or more sensors. A central controller may be general- or special-purpose. For example, one type of central controller is a home automation network that collects and analyzes data from one or more sensors within the home. Another example of a central controller is a special-purpose controller that is dedicated to a subset of functions, such as a security controller that collects and analyzes sensor data primarily or exclusively as it relates to various security considerations for a location. A central controller may be located locally with respect to the sensors with which it communicates and from which it obtains sensor data, such as in the case where it is positioned within a home that includes a home automation and/or sensor network. Faults and/or other issues with sensors may be reported to the central controller. If the communications network that the sensors and the central controller are part of experiences connectivity issues, data to authenticate users so as to allow entry, and/or arming and/or disarming of the security system may be stored at individual sensors that may serve as access points to the home and/or building. Alternatively or in addition, a central controller as disclosed herein may be remote from the sensors, such as where the central controller is implemented as a cloud-based system that communicates with multiple sensors, which may be located at multiple locations and may be local or remote with respect to one another.

FIGS. 7A-7B show examples of a security system having a sensor network as disclosed herein, which may be implemented over any suitable wired and/or wireless communication networks. One or more sensors 71, 72 may communicate via a local network 70, such as a Wi-Fi or other suitable network, with each other and/or with a controller 73. The security system 200 shown in FIGS. 2A-2B may be communicatively coupled to the network 70.

FIGS. 7A-7B show an example of a security system and/or smart-home network as disclosed herein, which may be implemented over any suitable wired and/or wireless communication networks. One or more sensors 71, 72 may communicate via a local network 70, such as a Wi-Fi or other suitable network, with each other and/or with a controller 73. The devices of the security system and smart-home environment of the disclosed subject matter may be communicatively connected via the network 70, which may be a mesh-type network such as Thread, which provides network architecture and/or protocols for devices to communicate with one another. Typical home networks may have a single device point of communications. Such networks may be prone to failure, such that devices of the network cannot communicate with one another when the single device point does not operate normally. The mesh-type network of Thread, which may be used in the security system of the disclosed subject matter, may avoid communication using a single device. That is, in the mesh-type network, such as network 70, there is no single point of communication that may fail so as to prohibit devices coupled to the network from communicating with one another.

The communication and network protocols used by the devices communicatively coupled to the network 70 may provide secure communications, minimize the amount of power used (i.e., be power efficient), and support a wide variety of devices and/or products in a home, such as appliances, access control, climate control, energy management, lighting, safety, and security. For example, the protocols supported by the network and the devices connected thereto may have an open protocol which may carry IPv6 natively.

The Thread network, such as network 70, may be easy to set up and secure to use. The network 70 may use an authentication scheme, AES (Advanced Encryption Standard) encryption, or the like to reduce and/or minimize security holes that exist in other wireless protocols. The Thread network may be scalable to connect devices (e.g., 2, 5, 10, 20, 50, 100, 150, 200, or more devices) into a single network supporting multiple hops (e.g., so as to provide communications between devices when one or more nodes of the network is not operating normally). The network 70, which may be a Thread network, may provide security at the network and application layers. One or more devices communicatively coupled to the network 70 (e.g., controller 73, remote system 74, and the like) may store product install codes to ensure only authorized devices can join the network 70. One or more operations and communications of network 70 may use cryptography, such as public-key cryptography.

The devices communicatively coupled to the network 70 of the smart-home environment and/or security system disclosed herein may low power consumption and/or reduced power consumption. That is, devices efficiently communicate to with one another and operate to provide functionality to the user, where the devices may have reduced battery size and increased battery lifetimes over conventional devices. The devices may include sleep modes to increase battery life and reduce power requirements. For example, communications between devices coupled to the network 70 may use the power-efficient IEEE 802.15.4 MAC/PHY protocol. In implementations of the disclosed subject matter, short messaging between devices on the network 70 may conserve bandwidth and power. The routing protocol of the network 70 may reduce network overhead and latency. The communication interfaces of the devices coupled to the smart-home environment may include wireless system-on-chips to support the low-power, secure, stable, and/or scalable communications network 70.

The controller 73 shown in FIGS. 7A-7B may be communicatively coupled to the network 70 and may be and/or include a processor. Alternatively, or in addition, the controller 73 may be a general- or special-purpose computer. The security system 200 shown in FIGS. 2A-2B may be part of controller 73 and/or may be separate from, but controlled by, controller 73. The controller 73 may, for example, receive, aggregate, and/or analyze environmental information received from the sensors 71, 72. The sensors 71, 72 and the controller 73 may be located locally to one another, such as within a single dwelling, office space, building, room, or the like, or they may be remote from each other, such as where the controller 73 is implemented in a remote system 74 such as a cloud-based reporting and/or analysis system. Alternatively or in addition, sensors 71, 72 may communicate directly with a remote system 74. The remote system 74 may, for example, aggregate data from multiple locations, provide instruction, software updates, and/or aggregated data to a controller 73 and/or sensors 71, 72.

The sensor network shown in FIGS. 7A-7B may be an example of a smart-home environment. The depicted smart-home environment may include a structure, a house, office building, garage, mobile home, or the like. The devices of the smart home environment, such as the sensors 71, 72, the controller 73, and the network 70 may be integrated into a smart-home environment that does not include an entire structure, such as an apartment, condominium, or office space.

The smart-home environment can control and/or be coupled to devices outside of the structure. For example, one or more of the sensors 71, 72 may be located outside the structure, for example, at one or more distances from the structure (e.g., sensors 71, 72) may be disposed outside the structure, at points along a land perimeter on which the structure is located, and the like. One or more of the devices in the smart home environment need not physically be within the structure. For example, the controller 73 which may receive input from the sensors 71, 72 may be located outside of the structure.

The structure of the smart-home environment may include a plurality of rooms, separated at least partly from each other via walls. The walls can include interior walls or exterior walls. Each room can further include a floor and a ceiling. Devices of the smart-home environment, such as the sensors 71, 72, may be mounted on, integrated with and/or supported by a wall, floor, or ceiling of the structure.

The smart-home environment including the sensor network shown in FIGS. 7A-7B may include a plurality of devices, including intelligent, multi-sensing, network-connected devices, that can integrate seamlessly with each other and/or with a central server or a cloud-computing system (e.g., controller 73 and/or remote system 74) to provide home-security and smart-home features. The smart-home environment may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entryway interface devices (e.g., "smart doorbells"). The smart hazard detectors, smart thermostats, and smart doorbells may be the sensors 71, 72 shown in FIGS. 7A-7B.

For example, a smart thermostat may detect ambient climate characteristics (e.g., temperature and/or humidity) and may control an HVAC (heating, ventilating, and air conditioning) system accordingly of the structure. For example, the ambient client characteristics may be detected by sensors 71, 72 shown in FIGS. 7A-7B, and the controller 73 may control the HVAC system (not shown) of the structure.

As another example, a smart hazard detector may detect the presence of a hazardous substance or a substance indicative of a hazardous substance (e.g., smoke, fire, or carbon monoxide). For example, smoke, fire, and/or carbon monoxide may be detected by sensors 71, 72 shown in FIGS. 7A-7B, and the controller 73 may control an alarm system to provide a visual and/or audible alarm to the user of the smart-home environment.

As another example, a smart doorbell may control doorbell functionality, detect a person's approach to or departure from a location (e.g., an outer door to the structure), and announce a person's approach or departure from the structure via audible and/or visual message that is output by a speaker and/or a display coupled to, for example, the controller 73.

In some implementations, the smart-home environment of the sensor network shown in FIGS. 7A-7B may include one or more intelligent, multi-sensing, network-connected wall switches (e.g., "smart wall switches"), one or more intelligent, multi-sensing, network-connected wall plug interfaces (e.g., "smart wall plugs"). The smart wall switches and/or smart wall plugs may be or include one or more of the sensors 71, 72 shown in FIGS. 7A-7B. A smart wall switch may detect ambient lighting conditions, and control a power and/or dim state of one or more lights. For example, a sensor such as sensors 71, 72, may detect ambient lighting conditions, and a device such as the controller 73 may control the power to one or more lights (not shown) in the smart-home environment. Smart wall switches may also control a power state or speed of a fan, such as a ceiling fan. For example, sensors 72, 72 may detect the power and/or speed of a fan, and the controller 73 may adjusting the power and/or speed of the fan, accordingly. Smart wall plugs may control supply of power to one or more wall plugs (e.g., such that power is not supplied to the plug if nobody is detected to be within the smart-home environment). For example, one of the smart wall plugs may controls supply of power to a lamp (not shown).

In implementations of the disclosed subject matter, a smart-home environment may include one or more intelligent, multi-sensing, network-connected entry detectors (e.g., "smart entry detectors"). Such detectors may be or include one or more of the sensors 71, 72 shown in FIGS. 7A-7B. The illustrated smart entry detectors (e.g., sensors 71, 72) may be disposed at one or more windows, doors, and other entry points of the smart-home environment for detecting when a window, door, or other entry point is opened, broken, breached, and/or compromised. The smart entry detectors may generate a corresponding signal to be provided to the controller 73 and/or the remote system 74 when a window or door is opened, closed, breached, and/or compromised. In some implementations of the disclosed subject matter, the alarm system, which may be included with controller 73 and/or coupled to the network 70 may not arm unless all smart entry detectors (e.g., sensors 71, 72) indicate that all doors, windows, entryways, and the like are closed and/or that all smart entry detectors are armed.

The smart-home environment of the sensor network shown in FIGS. 7A-7B can include one or more intelligent, multi-sensing, network-connected doorknobs (e.g., "smart doorknob"). For example, the sensors 71, 72 may be coupled to a doorknob of a door (e.g., doorknobs 122 located on external doors of the structure of the smart-home environment). However, it should be appreciated that smart doorknobs can be provided on external and/or internal doors of the smart-home environment.

The smart thermostats, the smart hazard detectors, the smart doorbells, the smart wall switches, the smart wall plugs, the smart entry detectors, the smart doorknobs, the keypads, and other devices of a smart-home environment (e.g., as illustrated as sensors 71, 72 of FIGS. 7A-7B can be communicatively coupled to each other via the network 70, and to the controller 73 and/or remote system 74 to provide security, safety, and/or comfort for the smart home environment).

A user can interact with one or more of the network-connected smart devices (e.g., via the network 70). For example, a user can communicate with one or more of the network-connected smart devices using a computer (e.g., a desktop computer, laptop computer, tablet, or the like) or other portable electronic device (e.g., a smartphone, smart watch, wearable computing device, a tablet, a key FOB, a radio frequency and the like). A webpage or application can be configured to receive communications from the user and control the one or more of the network-connected smart devices based on the communications and/or to present information about the device's operation to the user. For example, the user can view the webpage and/or the application, and can arm or disarm the security system of the home.

One or more users can control one or more of the network-connected smart devices in the smart-home environment using a network-connected computer or portable electronic device. In some examples, some or all of the users (e.g., individuals who live in the home) can register their mobile device and/or key fobs with the smart-home environment (e.g., with the controller 73). Such registration can be made at a central server (e.g., the controller 73 and/or the remote system 74) to authenticate the user and/or the electronic device as being associated with the smart-home environment, and to provide permission to the user to use the electronic device to control the network-connected smart devices and the security system of the smart-home environment. A user can use their registered electronic device to remotely control the network-connected smart devices and security system of the smart-home environment, such as when the occupant is at work or on vacation. The user may also use their registered electronic device to control the network-connected smart devices when the user is located inside the smart-home environment.

Alternatively, or in addition to registering electronic devices, the smart-home environment may make inferences about which individuals live in the home and are therefore users and which electronic devices are associated with those individuals. As such, the smart-home environment may "learn" who is a user (e.g., an authorized user) and permit the electronic devices associated with those individuals to control the network-connected smart devices of the smart-home environment (e.g., devices communicatively coupled to the network 70), in some implementations including sensors used by or within the smart-home environment. The smart-home environment may provide notifications to users when there is an attempt to use network-connected smart devices in a manner that is atypical from the learned pattern of usage. Various types of notices and other information may be provided to users via messages sent to one or more user electronic devices. For example, the messages can be sent via email, short message service (SMS), multimedia messaging service (MMS), unstructured supplementary service data (USSD), as well as any other type of messaging services and/or communication protocols.

A smart-home environment may include communication with devices outside of the smart-home environment but within a proximate geographical range of the home. For example, the smart-home environment may include an outdoor lighting system (not shown) that communicates information through the communication network 70 or directly to a central server or cloud-computing system (e.g., controller 73 and/or remote system 74) regarding detected movement and/or presence of people, animals, and any other objects and receives back commands for controlling the lighting accordingly.

The controller 73 and/or remote system 74 can control the outdoor lighting system based on information received from the other network-connected smart devices in the smart-home environment. For example, in the event any of the network-connected smart devices, such as smart wall plugs located outdoors, detect movement at night time, the controller 73 and/or remote system 74 can activate the outdoor lighting system and/or other lights in the smart-home environment.

The one or more sensors 71, 72 shown in FIGS. 7A-7B may be magnetic field sensors, AIR sensors, PIR sensors, camera, and/or motion sensors that detect a security event when a door and/or window of a building having the security system disclosed herein has been opened and/or compromised. In yet another example, the one or more sensors 71, 72 may be a smoke sensor and/or a carbon monoxide sensor that detect an environmental event when smoke is sensed and/or carbon monoxide is sensed.

In implementations of the disclosed subject matter, the remote system 74 shown in FIGS. 7A-7B may be a law enforcement provider system, a home security provider system, a medical provider system, and/or a fire department provider system. When a security event and/or environmental event is detected by at least one of one sensors 71, 72, a message may be transmitted to the remote system 74. The content of the message may be according to the type of security event and/or environmental event detected by the sensors 71, 72. For example, if smoke is detected by one of the sensors 71, 72, the controller 73 may transmit a message to the remote system 74 associated with a fire department to provide assistance with a smoke and/or fire event (e.g., request fire department response to the smoke and/or fire event). Alternatively, the sensors 71, 72 may generate and transmit the message to the remote system 74. In another example, when one of the sensors 71, 72 detects a security event, such a window or door of a building being compromised, a message may be transmitted to the remote system 74 associated with local law enforcement to provide assistance with the security event (e.g., request a police department response to the security event).

The controller 73 and/or the remote system 74 may include a display to present an operational status message (e.g., a security event, an environmental event, an operational condition, or the like), according to information received from at least one or the sensors 71, 72. For example, the display of the controller 73 and/or remote system 74 may display the operational status message to a user while the user is away from the building having the security system disclosed herein. Alternatively, or in addition, the controller 73 may display the operational status message to a user when the user arrives at and/or departs (i.e., exits) from the building. For example, one or more sensors may identify and authenticate the user (e.g., using images captured by the sensor, and comparing them with pre-stored images, and/or according to identifying information from the device of a user, such as a smartphone, smart watch, wearable computing device, key fob, RFID tag, or the like), and the security system may display the operational status message.

FIG. 7B shows a security system of a smart home environment as disclosed herein that includes an alarm device 76, which may include a light and an audio output device. The alarm device 76 may be controlled, for example, by controller 73. The light of the alarm device 76 may be activated so as to be turned on when one or more sensors 71, 72 detect a security event and/or an environmental event. Alternatively, or in addition, the light may be turned on and off in a pattern (e.g., where the light is turned on for one second, and off for one second; where the light is turned on for two seconds, and off for one second, and the like) when one or more sensors 71, 72 detect a security event and/or an environmental event. Alternatively, or in addition, an audio output device of the alarm device 76 may include at least a speaker to output an audible alarm when a security event and/or an environmental event is detected by the one or more sensors 71, 72. For example, a security event may be when one or more sensors 71, 72 are motion sensors that detect motion either inside a building having the security system disclosed herein, or within a predetermined proximity to the building. The speaker of the alarm device 76 may, for example, output a message when the user arrives at the building or departs from the building according to the operational status of the security system (e.g., a security and/or environmental event has been detected, an operational issue with the security system has been detected, the security system has been armed and/or disarmed, or the like).

Figure 8:
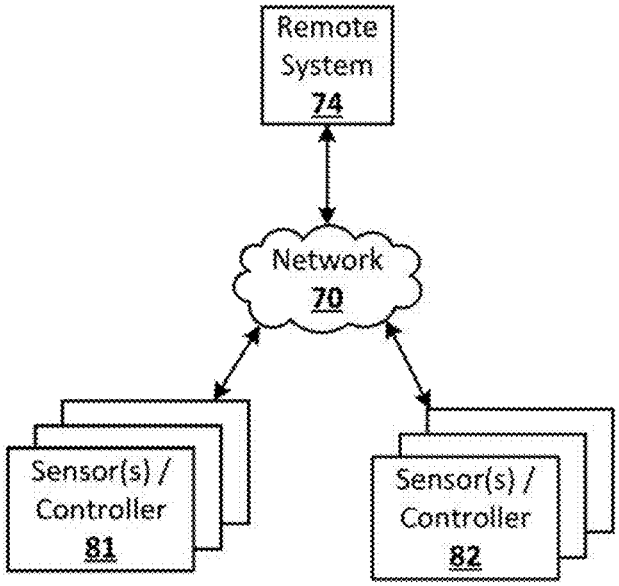
FIG. 8 shows a remote system to aggregate data from multiple locations having security systems according to an embodiment of the disclosed subject matter.

FIG. 7B shows a device 75 that may be communicatively coupled to a sensor. Although FIG. 7B illustrates that device 75 is coupled to sensor 72, the device 75 may be communicatively coupled to sensor 71 and/or sensor 72. The device 75 may be a computing device as shown in FIG. 8 and described below, and/or a key FOB. A user of the security system disclosed herein may control the device 75. When the device 75 is within a predetermined distance (e.g., one foot, five feet, 10 feet, 20 feet, 100 feet, or the like) from the sensor 72, the device 75 and the sensor 72 may communicate with one another via Bluetooth signals, Bluetooth Low Energy (BTLE) signals, Wi-Fi pairing signals, near field communication (NFC) signals, radio frequency (RF) signals, infra-red signals, and/or short-range communication protocol signals. For example, the user may present the device 75 within the predetermined distance range of the sensor so that the device 75 and the sensor may communicate with one another. The device 75 may provide identifying information to the sensor 72, which may be provided to the controller 73 to determine whether the device 75 belongs to an authorized user of the security system disclosed herein. The controller 73 may monitor the location of the device 75 in order to determine whether to arm or disarm the alarm device 76. The controller 73 may arm or disarm the alarm device 76 according to, for example, whether the device 75 is within a home, building, and/or a predetermined area. The predetermined area may be defined, for example, according to, for example, geofencing data, placement and/or range of sensors 71, 72, a defined distance from the building having the security system disclosed herein, and the like.

In example implementations of the disclosed subject matter, the device 75 may be associated with an authorized user. Authorized users may be those users, for example, who have identifying information stored and/or registered with the controller 73. Identifying information may include, for example, images of the user, voice recordings of the user, identification codes that are stored in a user's device, user PIN codes, and the like.

For example, when the authorized user and the device 75 are outside of the home, building, and/or predetermined area, the controller 73 may arm the alarm device 76. In determining whether to arm the alarm device 76, the controller may gather data from the sensors 71, 72, to determine whether any other person is in the building. When the alarm device 76 is armed, and the user and the device 75 return to the home, building, and/or predetermined area of the security system, the controller 73 may disarm the alarm device 76 according to the signals received by the sensors 71, 72 from the device 75. The exchanged signals may include the identifying information of the user.

In FIGS. 7A-7B, the sensor 71, 72 may be a camera to capture an image of a face of a person to be transmitted to the controller 73, where the controller 73 compares the captured facial image with a pre-stored image. When it is determined by the controller 73 that at least a portion of the captured facial image matches the pre-stored image, the controller 73 determines that the person is an authorized user of the security system disclosed herein. The controller 73 may arm or disarm the alarm device 76 according to the determination of whether the person is an authorized user.

The sensor 71, 72 may be a camera to capture a retinal image from a person to be transmitted to the controller 73, where the controller 73 compares the captured retinal image with a pre-stored image. When it is determined by the controller 73 that at least a portion of the captured retinal image matches the pre-stored image, the controller 73 determines that the person is an authorized user of the security system disclosed herein. The controller 73 may arm or disarm the alarm device 76 according to the determination of whether the person is an authorized user.

The sensor 71, 72 may be a microphone to capture a voice of a person to be transmitted to the controller 73, where the controller 73 compares the captured voice with a pre-stored voice. When it is determined by the controller 73 that at least a portion of the captured voice matches the pre-stored voice, the controller 73 determines that the person is an authorized user of the security system disclosed herein.

When the sensor 72 and/or the controller 73 determine that the device 75 is associated with an authorized user according to the transmitted identification information, the sensor 72 and/or the controller 73 provide an operational status message to the user via a speaker (i.e., audio output 77), a display (e.g., where the display is coupled to the controller 73 and/or remote system 74), and/or the device 75. The operational status message displayed can include, for example, a message that a security event and/or environmental event has occurred. When the sensors 71, 72 have not detected a security and/or environmental event, a message may be displayed that no security and/or environmental event has occurred. In implementations of the subject matter disclosed herein, the device 75 may display a source of the security event and/or environmental event, a type of the security event and/or environmental event, a time of the security event and/or environmental event, and a location of the security event and/or environmental event.

In implementations of the disclosed subject matter, the device 75 may be communicatively coupled to the network 70 so as to exchange data, information, and/or messages with the sensors 71, 72, the controller 73, and the remote system 74.

In implementations of the disclosed subject matter, the controller 73 can request entry of an access code from the device 75 and/or a keypad communicatively coupled to the controller 73. Upon receipt of the access code, the security system disclosed herein may be disarmed, and/or may provide an operational status message to the user via a display coupled to the controller 73 and/or the device 75. Alternatively, or in addition, an operational status message may be output via a speaker of the alarm device 76.

For example, a preset time (e.g., 15 seconds, 30 seconds, 1 minute, 5 minutes, or the like) may be set for the security system to allow for a user to exit the home or building before arming the alarm device 76. In some implementations, the security system may have a variable time to allow the user to exit. For example, the time may differ according to the user who is leaving (i.e., different users may have different leave times). As discussed above, the system may adjust the pre-alarm time to allow for a user to enter the home and disarm the alarm device 76. If a user needs more time to enter or exit the home with the security system, an electronic device of the user (e.g., a smartphone, smart watch, wearable computing device, radio frequency identification (RFID) tag, fitness band or sensor, a key FOB, or the like, such as device 75) can request, upon receiving input from the user, that the controller 73 provide additional time beyond the preset time to allow for the user to enter or exit the home. Alternatively, or in addition, the security system disclosed herein may extend the preset time to enter or exit. For example, the time may be extended for exiting the home while the user and/or the user's electronic device are in the home. That is, the sensors 71, 72 may determine that the user and/or the user's registered electronic device are in the home and are engaged in moving towards exiting, and the controller 73 may extend the preset time to exit. Alternatively, or in addition, the device 75 may transmit a command (e.g., when input is received from the user) to the controller 73 to disengage the exit process (e.g., the controller 73 and/or the alarm device 76 are disengaged from counting down the preset time before arming the alarm device 76).

In another example, when the user returns home, a preset time for entry to disarm the alarm device 76 may be extended according to whether the user has an electronic device (e.g., device 75, which may be a smartphone, smart watch, wearable computing device, RFID tag, fitness band or sensor, key FOB, or the like) that is registered with the controller 73. That is, the sensors, 71, 72 may detect the presence of the device 75 with the user, and may disarm the alarm device 76. When the sensors 71, 72 determine that the user does not have the device 75, the controller 73 may extend the preset time so that a user may be given additional time to enter a code on, for example, a keypad communicatively coupled to the controller 73, to disarm the alarm device 76.

As illustrated in FIGS. 7A-7B, a security system can include sensors (e.g., sensors 71, 72) to detect a location of at least one user, and generate detection data according to the detected location of at least one user of the security system. The detection data may be generated by the sensors 71, 72. For example, the at least one user may be one or more members of a household, and the security system may monitor their location using the sensors 71, 72 to determine whether to arm or disarm the alarm device 76. A processor, such as the controller 73 illustrated in FIGS. 7A-7B and described above, may be communicatively coupled to the sensors 71, 72, and can receive the detection data. The controller 73 can determine whether the at least one user is occupying a home, building, and/or within a predetermined area according to the detection data. The predetermined area may be set according to the boundaries of a home or building, geofencing data, motion data, a door position event, a distance from one or more sensors, and the like.

In determining the location of a user, the sensors 71, 72 can detect the location of one or more electronic devices (e.g., device 75) associated with a user. The one or more devices may be registered with the controller 73 and/or the remote system 74. As discussed above, sensors 71, 72 may communicate with another via Bluetooth signals, Bluetooth Low Energy (BTLE) signals, Wi-Fi pairing signals, near field communication (NFC) signals, radio frequency (RF) signals, infra-red signals, and/or short-range communication protocol signals. The device 75 may provide identifying information to the sensor 72, which may be provided to the controller 73 and/or the remote system 74 to determine whether the device 75 belongs to an authorized user of the security system disclosed herein. When the controller 73 and/or the remote system 74 determine that the device is an authorized device of the user, the controller 73 and/or the remote system 74 may determine the location of the device 75.

The sensors 71, 72 may be used determine whether the user associated with the device 75 can be identified with the device. For example, the sensors 71, 72 can determine whether an authorized user has a physical presence with the registered device (e.g., device 75), or whether an unauthorized person has possession of an authorized device. For example, as discussed above, a sensor 71, 72 having a camera can capture an image to determine if an authorized user has possession of the located device 75.

In some implementations, the sensors 71, 72 can detect a location of the user is outside of the home, building, and/or predetermined area, and that a user's first electronic device (e.g., a smartphone, smart watch, wearable computing device, or the like) is within the home, building, and/or predetermined area. The controller 73 can determine whether to arm the alarm device 76 according one a location of a user's second electronic device (e.g., a key FOB, RFID tag, fitness band or sensor, or the like), geofencing data, and the detection data from the sensors 71, 72.

The security system disclosed herein includes an alarm device, such as the alarm device 76 illustrated in FIG. 7B and discussed above, which can be armed or disarmed by the controller 73 according to the determination as to whether the at least one user is occupying the home or building, and/or within the predetermined area.

For example, if the controller 73 determines that the members of a household (e.g., the users of the home security system) have exited the house (e.g., are no longer occupying the home or building, and are outside of the predetermined area), the controller 73 may arm the alarm device 76. After exiting, controller 73 may request confirmation from the user, via the device 75, to arm the alarm. The sensors 71, 72 may determine the location of the members of the household according to their respective electronic devices (e.g., smartphones, smart watch, wearable computing device, tablet computers, key FOBs, RFID tag, fitness band or sensor, and the like), according to images captured by the sensors, according to the sensors detecting one or more doors opening and closing, and the like.

For example, the sensors 71, 72 may detect one or more doors opening and/or closing, the controller 73 may determine an approximate location of a user, according to the location of the sensor for the door, and what direction the door was opened and/or closed in. The data generated by the door sensors 71, 72 regarding the directional opening of the door, as well as the location of the sensor, may be used along with other sensor data from sensors 71, 72 (e.g., motion data, camera images, sound data, and/or thermal data, and the like) to provide an improved location determination of the user.

The security system may employ a magnetometer affixed to a door jamb and a magnet affixed to the door. When the door is closed, the magnetometer may detect the magnetic field emanating from the magnet. If the door is opened, the increased distance may cause the magnetic field near the magnetometer to be too weak to be detected by the magnetometer. If the security system is activated, it may interpret such non-detection as the door being ajar or open. In some configurations, a separate sensor or a sensor integrated into one or more of the magnetometer and/or magnet may be incorporated to provide intelligence as to the status of the door. For example, an accelerometer and/or a compass may be affixed to the door and indicate the status of the door and/or augment the data provided by the magnetometer.

In some configurations, an accelerometer may be employed to indicate how quickly the door is moving. For example, the door may be lightly moving due to a breeze. This may be contrasted with a rapid movement due to a person swinging the door open. The data generated by the compass, accelerometer, and/or magnetometer may be analyzed and/or provided to a central system such as a controller 73 and/or remote system 74 as previously described. The data may be analyzed to learn a user behavior, an environment state, and/or as a component of a home security or home automation system. While the above example is described in the context of a door, a person having ordinary skill in the art will appreciate the applicability of the disclosed subject matter to other implementations such as a window, garage door, fireplace doors, vehicle windows/doors, faucet positions (e.g., an outdoor spigot), a gate, seating position, etc.

The controller 73 may aggregate detection data from the sensors 71, 72 and store it in a storage device coupled to the controller 73 or the network 70. The data aggregated by the controller 73 may be used to determine entrance and exit patterns (e.g., what days and times users enter and exit from the house, what doors are used, and the like) of the members of the household, and the controller 73 may arm or disarm the alarm device 76 according to the determined patterns.

In implementations of the disclosed subject matter, one or more user electronic devices (e.g., device 75) can be registered with the processor, and the at least one of the sensors 71, 72 transmits a location request signal to the device 75. In response to the location request signal, the device 75 can transmits a location signal, and the controller 73 can determine the location of the device 75 according to the received location signal. The location request signal and the location signal can be Bluetooth signals, Bluetooth Low Energy (BTLE) signals, radio frequency (RF) signals, near field communications (NFC) signals, and the like.

The controller 73 can transmit a request message to be displayed by the device 75. The message may be, for example, a reminder to arm or disarm the alarm device 76. Upon displaying the message the electronic device receives input to arm or disarm the alarm device 76 according to the displayed request message, and transmits the received input to the controller 73 so as to control the alarm device 76. For example, the controller can request a code from the user to either arm or disarm the alarm device 76. When the user provides the code to the device 75, which correspondingly transmits the entered code to the controller 73, the controller 73 may control the arming or disarming of the alarm device 76. Alternatively, or in addition, the controller 73 can control the alarm device 76 to be automatically armed when the user is no longer occupying the home or building, and/or is outside of the predetermined area. Alternatively, or in addition, the controller may control the arming or disarming of the alarm device 76 according to a code that entered in a keypad that is communicatively coupled to the controller 73.

In implementations of the disclosed subject matter, authentication requirements for arming or disarming of the alarm device 76 may be reduced when a device 75 is used to arm or disarm, and the device 75 is a registered device. When a button on the registered device 75 or displayed by the device 75 is used to arm or disarm the alarm device 76, the user may not have to enter a code, a shortened PIN code, a voice code, or the like.

When the sensors 71, 72 for an entry door to the home or building become disconnected from the network 70 and the controller 73, and the alarm device 76 is armed, the user may still re-enter the home. The security system may learn which doors are used by the user to enter and/or exit a home. The sensors 71, 72 associated with the doors that are used to enter and/or exit the home may store identifying information, so that the user may present a device 75 to the sensors 71, 72 to exchange identifying information to allow the user to enter the door. Once the user enters, the user may manually disarm the alarm device 76 by entering a security code.

The security system may learn the how the user typically arms and disarms the alarm device 76 (e.g., using a keypad, using the device 75, allowing for auto-arming, or the like). The device 75 may receive a message from the controller 73 when there is an attempt to disarm the alarm device 76 at a time of day and/or in a manner that is inconsistent with a user history or pattern for disarming. The controller 73 may request that the user of device 75 confirm whether the disarming is authorized, and may provide information from sensors 71, 72 (e.g., images captured of the person attempting the disarming) to assist in the confirmation. Via the device 75, the user may confirm or deny the request by the controller 73 to disarm the alarm device In implementations of the disclosed subject matter, the alarm device 76 can be armed or disarmed by the controller 73 according to geo-location data from the sensors 71, 72 and/or the device 75. For example, if the sensors 71, 72 determine that the device 75 is physically located with an authorized user (e.g., as discussed above) according to geo-location data received from the device 75, and the user has exited the home and there are no other users in the home according to the sensors 71, 72, the controller 73 can automatically arm the alarm device. Alternatively, the controller may transmit a request message to the device 75 to determine if the user would like to arm the alarm device 76. For example, the message may display a selectable button to arm or disarm the alarm device 76. In another example, one or more sensors 71, 72 may determine the geo-location of an authorized user who is exiting the home, and may determine that one or more users are still located in the home according to geo-location data, and the controller 73 may refrain from arming the alarm device 76 to allow for the one or more users still in the home to exit. In yet another example, the sensors 71, 72 may determine the geo-location of an authorized user who has exited the home, and determine that one or more users are still located within the home, and the controller 73 may automatically arm the alarm device 76 to activate an audio and/or visual alarm when a defined outer perimeter is breached by an unauthorized user or when a door leading outside of the home is opened, but may not activate the alarm when doors internal to the home are opened or closed.

In some implementations, the alarm device 76 can be armed or disarmed when the controller 73 determines that the device 75 and/or sensors 71, 72 are disconnected from the communications network 70 coupled to the alarm device 76. For example, if device 75 and/or sensors 71, 72 are disconnected from the network 70 so as to be decoupled from the controller 73 and/or remote system 74, the controller 73 may arm the alarm device 76. That is, the network 70 may be a wireless network having a predetermined communicative range within and/or around the perimeter of a house or building. When an authorized device 75 becomes decoupled from the network 70 (e.g., because the device 75 is outside of the predetermined communicative range) and/ or the sensors 71, 72 become decoupled from the network 70, the controller 73 may automatically arm the alarm device 76.

In the security system disclosed herein, sensors 71, 72 can detect a security event, such as a door event (e.g., where a door to a house is opened, closed, and/or compromised) or a window event (e.g., where a window of a house is opened, closed, and/or compromised). For example, the sensors 71, 72 may have an accelerometer that identifies the force on the door or window as a compromising event. In another example, the sensors 71, 72 may contain an accelerometer and/or compass, and the compromising event may dislodge the sensor from the door or window, and the motion of the sensor 71, 72 may identify the motion as a compromising event. The controller 73 may activate the alarm device 76 according to whether the detected door event or window event is from an outside location (e.g., outside the house, building, or the like). That is, the controller 73 may control the alarm device 76 to output an audible alarm and/or message via a speaker when a door event or window event is detected by the sensors 71, 72. A light of the alarm device 76 may be activated so as to be turned on when one or more sensors 71, 72 detect a security event, such as a door or window event. Alternatively, or in addition, a light may be turned on and off in a pattern (e.g., where the light is turned on for one second, and off for one second; where the light is turned on for two seconds, and off for one second, and the like) when one or more sensors 71, 72 detect a security event such as the window and/or door event.

The controller 73 can control the alarm device 76 to be armed or disarmed according to a preset time period for a user to enter or exit a home or building associated with the security system. The predetermined time can be adjusted by the controller 73 according to the user. For example, as discussed herein, the controller 73 can aggregate data from the sensors 71, 72 to determine when a user enters and exits the home (e.g., the days and times for entry and exit, the doors associated with the entry and exit, and the like). For example, the controller 73 can adjust the amount of time for arming the alarm device 76 to be longer or shorter, according to the amount of time the user takes to exit the house according to the aggregated data.

In the security system disclosed herein the at least one sensor determines that the user is not occupying the home or building, and/or is outside of the predetermined area for a time greater than a preset time, the controller 73 can control the alarm device 76 to transition from a first security mode to a second security mode. The second security mode may provide a higher level of security than the first security mode. For example, the second security mode may be a "vacation" mode, where the user of the security system disclosed herein (e.g., the members of a household) are away from the house for a period of time (e.g., 1 day, 3 days, 5 days, 1 week, 2 weeks, 1 month, or the like). As discussed herein, the controller 73 may aggregate the detection data received from the sensors 71, 72 over a preset time (e.g., 1 week, 1 month, 6 months, 1 year, or the like) to determine a pattern for when the user is within the predetermined location or not.

In some configurations, as illustrated in FIG. 8, a remote system 74 may aggregate data from multiple locations, such as multiple buildings, multi-resident buildings, and individual residences within a neighborhood, multiple neighborhoods, and the like. In general, multiple sensor/controller systems 81, 82 as previously described with respect to FIGS. 7A-7B may provide information to the remote system 74. The systems 81, 82 may provide data directly from one or more sensors as previously described, or the data may be aggregated and/or analyzed by local controllers such as the controller 73, which then communicates with the remote system 74. The remote system may aggregate and analyze the data from multiple locations, and may provide aggregate results to each location. For example, the remote system 74 may examine larger regions for common sensor data or trends in sensor data, and provide information on the identified commonality or environmental data trends to each local system 81, 82.

For example, remote system 74 may gather and/or aggregate security event and/or environmental event data from systems 81, 82, which may be geographically proximally located to the security system illustrated in FIGS. 7A-7B. The systems 81, 82 may be located within one-half mile, one mile, five miles, ten miles, 20 miles, 50 miles, or any other suitable distance from the security system of a user, such as the security system shown in FIGS. 7A-7B. The remote system 74 may provide at least a portion of the gathered and/or aggregated data to the controller 73 and/or the device 75 illustrated in FIG. 7B.

The user of the device 75 may receive information from the controller 73 and/or the remote system 74 regarding a security event that is geographically proximally located to the user of the device 75 and/or the security system of a building (e.g., a home, office, or the like) associated with the user. Alternatively, or in addition, an application executed by the device 75 may provide a display of information from systems 81, 82, and/or from the remote system 74.

For example, an unauthorized entry to a building associated with systems 81, 82 may occur, where the building is within one-half mile from the building associated with the user of the device 75. The controller 73 and/or the remote system 74 may transmit a message (e.g., a security alert message) to the device 75 that an unauthorized entry has occurred in a nearby building, thus alerting the user to security concerns and/or potential security threats regarding their geographically proximally located building.

In another example, a smoke and/or fire event of a building associated with systems 81, 82 may occur, where the building is within 500 feet from the building associated with the user of the device 75. The controller 73 and/or the remote system 74 may transmit a message (e.g., a hazard alert message) to the device 75 that the smoke and/or fire event has occurred in a nearby building, thus alerting the user to safety concerns, as well as potential smoke and/or fire damage to their geographically proximally located building.

In situations in which the systems discussed here collect personal information about users, or may make use of personal information, the users may be provided with an opportunity to control whether programs or features collect user information (e.g., a user's current location, a location of the user's house or business, or the like), or to control whether and/or how to receive content from the content server that may be more relevant to the user. In addition, certain data may be treated in one or more ways before it is stored or used, so that personally identifiable information is removed. For example, specific information about a user's residence may be treated so that no personally identifiable information can be determined for the user, or a user's geographic location may be generalized where location information is obtained (such as to a city, ZIP code, or state level), so that a particular location of a user cannot be determined. As another example, systems disclosed herein may allow a user to restrict the information collected by those systems to applications specific to the user, such as by disabling or limiting the extent to which such information is aggregated or used in analysis with other information from other users. Thus, the user may have control over how information is collected about the user and used by a system as disclosed herein.

Implementations of the presently disclosed subject matter may be implemented in and used with a variety of computing devices. FIG. 9 is an example computing device 75 suitable for implementing implementations of the presently disclosed subject matter. The device 75 may be used to implement a controller, a device including sensors as disclosed herein, or the like. Alternatively or in addition, the device 75 may be, for example, a desktop or laptop computer, or a mobile computing device such as a smart phone, smart watch, wearable computing device, tablet, key FOB, RFID tag, fitness band or sensor, or the like. The device 75 may include a bus 21 which interconnects major components of the device 75, such as a central processor 24, a memory 27 such as Random Access Memory (RAM), Read Only Memory (ROM), flash RAM, or the like, a user display 22 such as a display screen and/or lights (e.g., green, yellow, and red lights, such as light emitting diodes (LEDs) to provide the operational status of the security system to the user, as discussed above), a user input interface 26, which may include one or more controllers and associated user input devices such as a keyboard, mouse, touch screen, and the like, a fixed storage 23 such as a hard drive, flash storage, and the like, a removable media component 25 operative to control and receive an optical disk, flash drive, and the like, and a network interface 29 operable to communicate with one or more remote devices via a suitable network connection.

The bus 21 allows data communication between the central processor 24 and one or more memory components 25, 27, which may include RAM, ROM, and other memory, as previously noted. Applications resident with the device 75 are generally stored on and accessed via a computer readable storage medium.

The fixed storage 23 may be integral with the device 75 or may be separate and accessed through other interfaces. The network interface 29 may provide a direct connection to a remote server via a wired or wireless connection. The network interface 29 may provide a communications link with the network 70, sensors 71, 72, controller 73, and/or the remote system 74 as illustrated in FIGS. 7A-7B. The network interface 29 may provide such connection using any suitable technique and protocol as will be readily understood by one of skill in the art, including digital cellular telephone, radio frequency (RF), Wi-Fi, Bluetooth®, Bluetooth Low Energy (BTLE), near-field communications (NFC), and the like. For example, the network interface 29 may allow the device to communicate with other computers via one or more local, wide-area, or other communication networks, as described in further detail herein.

Various implementations of the presently disclosed subject matter may include or be embodied in the form of computer-implemented processes and apparatuses for practicing those processes. Implementations also may be embodied in the form of a computer program product having computer program code containing instructions embodied in non-transitory and/or tangible media, such as hard drives, USB (universal serial bus) drives, or any other machine readable storage medium, such that when the computer program code is loaded into and executed by a computer, the computer becomes an apparatus for practicing implementations of the disclosed subject matter. When implemented on a general-purpose microprocessor, the computer program code may configure the microprocessor to become a special-purpose device, such as by creation of specific logic circuits as specified by the instructions.

Implementations may be implemented using hardware that may include a processor, such as a general purpose microprocessor and/or an Application Specific Integrated Circuit (ASIC) that embodies all or part of the techniques according to implementations of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to implementations of the disclosed subject matter.

The foregoing description, for purpose of explanation, has been described with reference to specific implementations. However, the illustrative discussions above are not intended to be exhaustive or to limit implementations of the disclosed subject matter to the precise forms disclosed. Many modifications and variations are possible in view of the above teachings. The implementations were chosen and described in order to explain the principles of implementations of the disclosed subject matter and their practical applications, to thereby enable others skilled in the art to utilize those implementations as well as various implementations with various modifications as may be suited to the particular use contemplated.

The invention claimed is:

1. A security system comprising:

a sensor to detect an entry into a building by a person, and generate detection data according to the detected entry;

a processor communicatively coupled to the sensor to receive the detection data, the processor to estimate a threat level based on the detection data and a security system operating state, and to adjust a pre-alarm time according to the estimated threat level; and an alarm device, communicatively coupled to at least the processor, that outputs an alarm according to the detection data and the threat level.

2. The system of claim 1, wherein the processor is configured to determine, at least according to the detection data, a location of the entry of the person.

3. The system of claim 2, wherein the processor adjusts the pre-alarm time for the alarm device at least according to the determined location of the entry of the person, wherein the alarm device outputs the alarm based on the adjusted pre-alarm time.

4. The system of claim 2, wherein the threat estimator of the processor determines a threat level at least according to the determined location of the entry.

5. The system of claim 1, wherein the threat estimator of the processor determines the threat level at least based on a time of day.

6. The system of claim 5, wherein the processor adjusts the pre-alarm time of the alarm device according to the determined threat level.

7. The system of claim 6, wherein the processor determines the pre-alarm time according to a selection by a user.

8. The system of claim 1, wherein the processor adjusts the pre-alarm time of the alarm device according to the detection data.

9. The system of claim 8, wherein the alarm device outputs the alarm according to the detection data and the adjusted pre-alarm time.

10. The system of claim 1, wherein the processor is configured to determine, according to the detection data, whether the person is an authorized user.

11. The system of claim 10, wherein the processor is configured to adjust the pre-alarm time of the alarm device so as to reduce the pre-alarm time when the person is not an authorized user.

12. The system of claim 10, wherein the processor is configured to adjust the pre-alarm time of the alarm device so as to increase the pre-alarm time when the person is determined to be an authorized user.

13. The system of claim 12, wherein the processor is configured to adjust the pre-alarm time based on the authorized user.

14. The system of claim 1, wherein the processor includes an alarm manager configured to determine the amount of time spent in the pre-alarm state and to determine whether to control the alarm device to output an alarm.

15. The system of claim 1, further comprising a database of events, wherein the processor is configured to determine whether the entry detected by the sensor is typical based on the database of events.

16. The system of claim 15, wherein the processor is configured to adjust the pre-alarm time of the alarm device according to the determination of whether the detected entry is typical based on the database of events.

17. The system of claim 15, wherein the processor is configured to determine whether one or more events after the detected entry is typical based on the database of events.

18. The system of claim 1, wherein the sensor includes a first sensor and a second sensor, and the processor is configured to adjust the pre-alarm time of the alarm device according to the detection data received from at least one of the first sensor and the second sensor.

19. The system of claim 18, wherein the processor is configured to adjust the pre-alarm time differently for the first sensor and the second sensor.

20. The system of claim 18, wherein the processor is configured to adjust the pre-alarm time according to a sequence of events received from the first sensor and the second sensor.

21. A method of operating a security system comprising:

detecting, by a sensor, an entry into a building by a person, and generating detection data according to the detected entry;

estimating, by a processor communicatively coupled to the sensor, a threat level using the detection data and a security system operating state, and adjusting a pre-alarm time according to the estimated threat level; and outputting an alarm, by an alarm device communicatively coupled to at least the processor, according to the detection data and the threat level.

22. The method of claim 21, further comprising:

determining, by the processor, at least according to the detection data, a location of the entry of the person.

23. The method of claim 22, further comprising:

adjusting the pre-alarm time for the alarm device at least according to the determined location of the entry of the person, wherein the alarm device outputs the alarm based on the adjusted pre-alarm time.

24. The method of claim 22, further comprising:

determining, by the threat estimator of the processor, a threat level at least according to the determined location of the entry.

25. The method of claim 21, further comprising:

determining, by the threat estimator of the processor, the threat level at least based on a time of day.

26. The method of claim 25, further comprising:

adjusting, by the processor, the pre-alarm time of the alarm device according to the determined threat level.

27. The method of claim 26, further comprising:

determining, by the processor, the pre-alarm time according to a selection by a user.

28. The method of claim 21, further comprising:

adjusting, by the processor, the pre-alarm time of the alarm device according to the detection data.

29. The method of claim 28, wherein the alarm device outputs the alarm according to the detection data and the adjusted pre-alarm time.

30. The method of claim 21, further comprising:

determining, by the processor, whether the person is an authorized user according to the detection data.

31. The method of claim 30, further comprising:

adjusting, by the processor, the pre-alarm time of the alarm device so as to reduce the pre-alarm time when the person is not an authorized user.

32. The method of claim 30, further comprising:

adjusting, by the processor, the pre-alarm time of the alarm device so as to increase the pre-alarm time when the person is determined to be an authorized user.

33. The method of claim 32, further comprising:

adjusting, by the processor, the pre-alarm time based on the authorized user.

34. The method of claim 21, further comprising:

determining, by the processor that includes an alarm manager, the amount of time spent in the pre-alarm state and to determine whether to control the alarm device to output an alarm.

35. The method of claim 21, further comprising:

determining, by the processor that is coupled to a database of events, whether the entry detected by the sensor is typical based on the database of events.

36. The method of claim 35, further comprising:

adjusting, by the processor, the pre-alarm time of the alarm device according to the determination of whether the detected entry is typical based on the database of events.

37. The method of claim 35, further comprising:

determining, by the processor, whether one or more events after the detected entry is typical based on the database of events.

38. The method of claim 21, further comprising:

adjusting, by the processor, the pre-alarm time of the alarm device according to the detection data received from the sensor, wherein the sensor includes at least one of a first sensor and a second sensor.

39. The method of claim 38, further comprising:

adjusting, by the processor, the pre-alarm time differently for the first sensor and the second sensor.

40. The method of claim 38, further comprising:

adjusting, by the processor, the pre-alarm time according to a sequence of events received from the first sensor and the second sensor.

* * * * *